US011104156B2

(12) United States Patent
Tsuchiya et al.

(10) Patent No.: US 11,104,156 B2
(45) Date of Patent: Aug. 31, 2021

(54) PRINTING APPARATUS, IMAGE PROCESSING APPARATUS, IMAGE PROCESSING METHOD, AND STORAGE MEDIUM

(71) Applicant: CANON KABUSHIKI KAISHA, Tokyo (JP)

(72) Inventors: Okinori Tsuchiya, Yokohama (JP); Takashi Fujita, Kawasaki (JP); Takeru Sasaki, Kawasaki (JP); Hiroaki Ogawa, Kawasaki (JP); Akitoshi Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 16/458,604

(22) Filed: Jul. 1, 2019

(65) Prior Publication Data

US 2020/0016905 A1 Jan. 16, 2020

(30) Foreign Application Priority Data

Jul. 13, 2018 (JP) ..... JP2018-133535

(51) Int. Cl.
*B41J 2/355* (2006.01)
*B41J 2/525* (2006.01)

(52) U.S. Cl.
CPC ..... *B41J 2/3558* (2013.01); *B41J 2/525* (2013.01)

(58) Field of Classification Search
CPC . B41J 2/3558; B41J 2/525; B41J 2/135; B41J 2/01; B41J 29/393; B41J 35/16; B41J 35/18; B41J 2002/0052; B41F 16/00; B41F 16/0006
See application file for complete search history.

(56) References Cited

U.S. PATENT DOCUMENTS

| | | | | |
|---|---|---|---|---|
| 6,293,646 | B1 | 9/2001 | Beachna et al. | 347/23 |
| 6,906,735 | B2 | 6/2005 | Bhatt et al. | 347/175 |
| 7,782,350 | B2 | 8/2010 | Tanaka et al. | 347/189 |
| 7,791,626 | B2 | 9/2010 | Busch et al. | 347/211 |
| 8,009,184 | B2 | 8/2011 | Saquib | 347/195 |
| 8,068,126 | B2 | 11/2011 | Busch et al. | 347/175 |

(Continued)

FOREIGN PATENT DOCUMENTS

| | | |
|---|---|---|
| CN | 1290602 | 4/2001 |
| CN | 1537059 | 10/2004 |

(Continued)

OTHER PUBLICATIONS

U.S. Appl. No. 16/429,535 to Hiroaki Ogawa, filed Jun. 3, 2019.

(Continued)

*Primary Examiner* — Kristal Feggins
(74) *Attorney, Agent, or Firm* — Venable LLP

(57) ABSTRACT

A printing apparatus includes a print head having a heat generation element, a generation unit that generates print data for driving the heat generation element to form an image on a print medium and a drive unit that drives the heat generation element on a basis of the print data generated by the generation unit. The print medium includes a laminate of a plurality of image forming layers that generate develop mutually different colors by receiving heat. The generation unit generates the print data depending on a type of the print medium among a plurality of print medium types that differ from each other in order of lamination of the plurality of image forming layers.

22 Claims, 20 Drawing Sheets

(56) References Cited

U.S. PATENT DOCUMENTS

| | | | | |
|---|---|---|---|---|
| 8,363,078 | B2 | 1/2013 | Kitamura | 347/218 |
| 9,296,214 | B2 | 3/2016 | Hunsberger | B41J 2/17546 |
| 2003/0125206 | A1 | 7/2003 | Bhatt et al. | |

FOREIGN PATENT DOCUMENTS

| | | | |
|---|---|---|---|
| CN | 101010201 | | 8/2007 |
| CN | 101200134 | | 6/2008 |
| CN | 101977775 | | 2/2011 |
| CN | 102202905 | | 9/2011 |
| CN | 102369111 | | 3/2012 |
| CN | 102785498 | | 11/2012 |
| JP | H0872414 | | 3/1996 |
| JP | H08174882 | | 7/1996 |
| JP | 2008-30486 | A | 2/2008 |
| JP | 4677431 | B2 | 4/2011 |

OTHER PUBLICATIONS

U.S. Appl. No. 16/503,809 to Takashi Fujita, filed Jul. 5, 2019.
Office Action dated Jan. 14, 2021 in counterpart Chinese Application No. 201910628727.7.

COLOR GAMUT

PRINTING APPARATUS, IMAGE PROCESSING APPARATUS, IMAGE PROCESSING METHOD, AND STORAGE MEDIUM

BACKGROUND OF THE INVENTION

Field of the Invention

The present invention relates to a printing apparatus and a printing method for printing a color image by a thermal method.

Description of the Related Art

Japanese Patent No. 4677431 discloses a print medium having three color development layers differing from each other in activation temperature, and a printing method for forming a color image by using this print medium. According to Japanese Patent No. 4677431, the temperature of heat to be applied to the front surface of the print medium and the time of the application are adjusted to individually activate the three color development layers, which are present at different positions in the depth direction, and thereby express a desired color.

However, the print medium disclosed in Japanese Patent No. 4677431 inevitably has a variation in a color reproduction range dependent on the order of lamination of the color development layers. Specifically, in a case of a print medium with the three color development layers disposed in the order of yellow, magenta, and cyan from the front surface, for example, the degree of development of magenta, which is located as the middle layer, tends to be lower than those of cyan and yellow. For this reason, the above print medium can express good colors for images that mainly use cyan and yellow, such as images of clouds or grassland, but may fail to express good colors expected by the user for images that mainly use magenta, such as images of autumn leaves.

SUMMARY OF THE INVENTION

The present invention has been made to solve the above problem. An object thereof is to provide a printing apparatus that prints an image by using a thermal method and is capable of outputting images having various hues by generating good colors.

According to a first aspect of the present invention, there is provided a printing apparatus comprising: a print head having a heat generation element; a generation unit configured to generate print data on a basis of image data, the print data being for driving the heat generation element to form an image in on a print medium including a laminate of a plurality of image forming layers that generate develop mutually different colors by receiving heat; and a drive unit configured to drive the heat generation element of the print head on a basis of the print data generated by the generation unit, wherein the generation unit generates the print data depending on a type of the print medium among a plurality of print medium types that differ from each other in order of lamination of the plurality of image forming layers.

According to a second aspect of the present invention, there is provided a An image processing apparatus that performs an image processing for printing an image on a print medium by using a print head having a heat generation element, the print medium including a laminate of a plurality of image forming layers that develop mutually different colors by receiving heat, the image processing apparatus comprising a generation unit configured to generate print data depending on a type of the print medium among a plurality of print medium types that differ from each other in order of lamination of the plurality of image forming layers, the print data being for driving the heat generation element for each of individual pixel regions.

According to a third aspect of the present invention, there is provided a An image processing method comprising: generating print data on a basis of image data, the print data being for forming an image on a print medium including a laminate of a plurality of image forming layers that generate mutually different colors by receiving heat; and driving a heat generation element of a print head on a basis of the print data generated by the generating, wherein the generating includes generating the print data depending on a type of the print medium among a plurality of print medium types that differ from each other in order of lamination of the plurality of image forming layers.

According to a fourth aspect of the present invention, there is provided a A non-transitory computer readable storage medium storing a program that causes a computer to function as units of a printing apparatus, the printing apparatus comprising: a generation unit configured to generate print data on a basis of image data, the print data being for forming an image on a print medium including a laminate of a plurality of image forming layers that generate mutually different colors by receiving heat; and a drive unit configured to drive a heat generation element of a print head on a basis of the print data generated by the generation unit, wherein the generation unit generates the print data depending on a type of the print medium among a plurality of print medium types that differ from each other in order of lamination of the plurality of image forming layers.

Further features of the present invention will become apparent from the following description of exemplary embodiments with reference to the attached drawings.

DESCRIPTION OF THE EMBODIMENTS

First Embodiment

Figure 1:
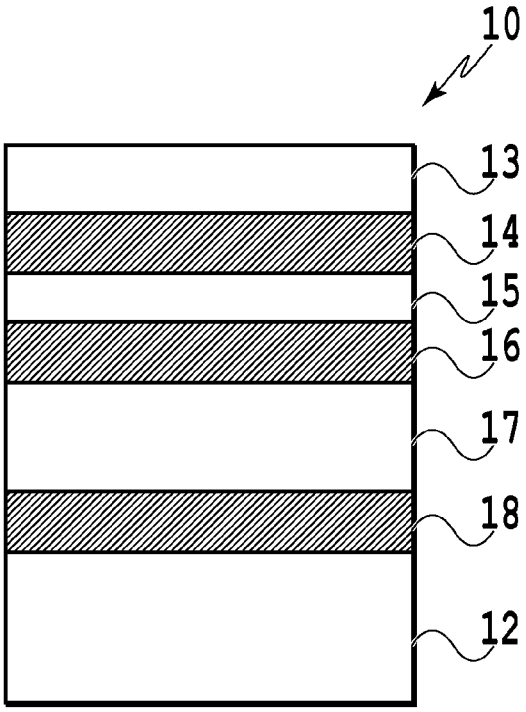
FIG. 1 is a diagram illustrating the structure of a print medium used in the following embodiments.

FIG. 1 is a diagram illustrating the structure of a print medium used in the present embodiment. A print medium 10 includes a third image forming layer 18, a second spacer layer 17, a second image forming layer 16, a first spacer layer 15, a first image forming layer 14, and a protection layer 13 laminated in this order on a base material 12. The protection layer 13 side (the upper side in the diagram) is the front surface and is a side with which a later-described print head comes into contact and from which a formed image is observed.

The base material 12 is a white layer that reflects light, and the protection layer 13 is a transparent layer. The first image forming layer 14, the second image forming layer 16, and the third image forming layer 18 are basically colorless and transparent but become activated at respective unique temperatures and develop different colors (yellow, magenta, and cyan).

The first spacer layer 15 and the second spacer layer 17 are layers for controlling diffusion of heat applied to the protection layer 13, and their thicknesses are adjusted in accordance with the rate of the heat diffusion, the activation temperatures of the three image forming layers, and so on.

The time taken for heat applied to the front surface to reach a lower image forming layer is dependent on the thickness of the spacer layer(s), and the applied heat is dissipated while being diffused. Then, by applying heat higher than the activation temperatures of upper and lower image forming layers to the front surface of the print medium for a short time, it is possible to activate only the upper image forming layer without activating the lower image forming layer. Also, by applying heat higher than the activation temperature of a lower image forming layer and lower than the activation temperature of an upper image forming layer for a long time, it is possible to activate the lower image forming layer without activating the upper image forming layer. Specifically, by adjusting the temperature of heat to be applied to the front surface of the protection layer 13 and the time of the application in accordance with image data, it is possible to individually activate the first image forming layer 14, the second image forming layer 16, and the third image forming layer 18 and adjust the color development.

In the print medium after an image is formed therein as above, light incident on the protection layer 13 travels through the spacer layer(s) and the image forming layer(s) that has not been activated and is reflected by the activated image forming layer or the base material 12. Thus, in a case of visually observing the print medium 10 from the front surface side, observers visually recognize colors corresponding to the combinations of light rays reflected by the individual image forming layers.

The colors (color materials) to be developed in the three image forming layers are not particularly limited. In the following, a description will be given of a case of using a print medium containing a yellow color material in the first image forming layer 14, a magenta color material in the second image forming layer 16, and a cyan color material in the third image forming layer 18.

Figure 2:
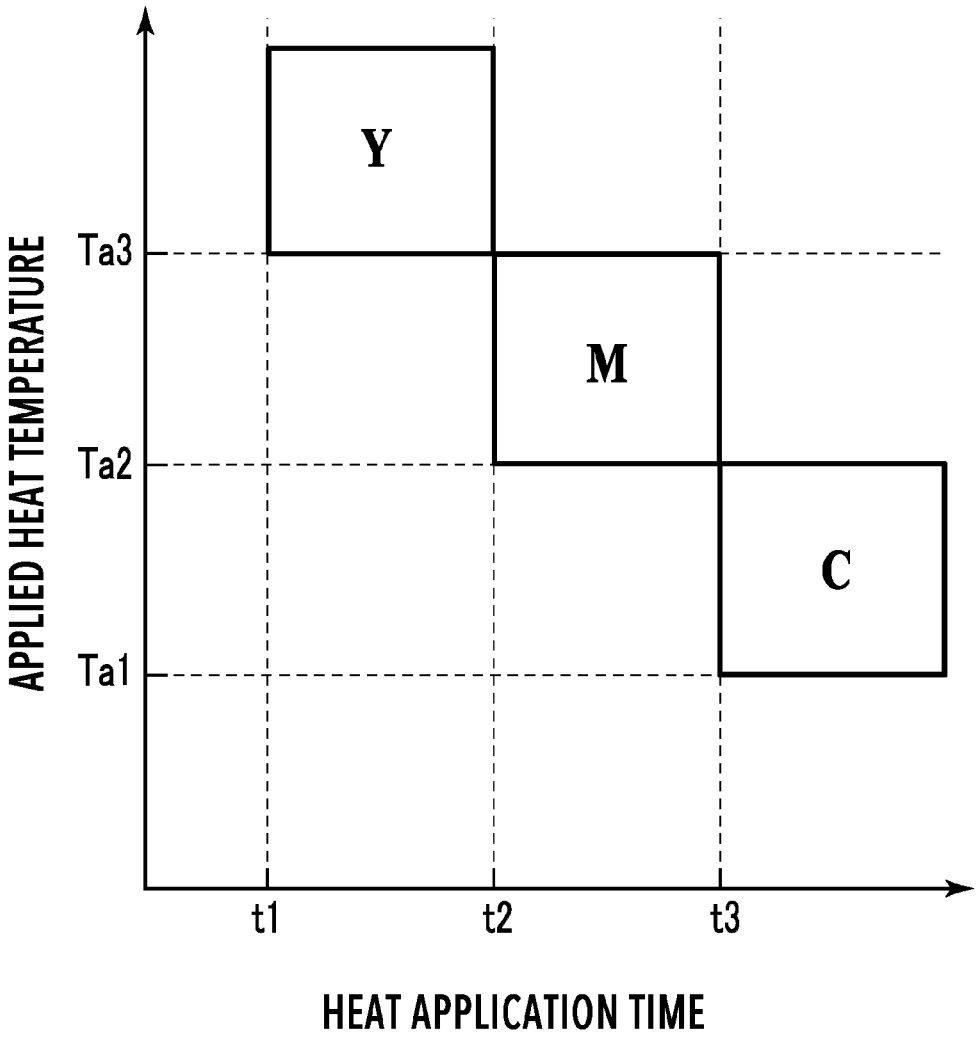
FIG. 2 is a diagram for explaining color development conditions for a first print medium.

FIG. 2 is a diagram for explaining color development conditions for the first print medium. In the diagram, the horizontal axis represents the time for which to heat the front surface of the print medium 10 while the vertical axis represents the temperature at which to heat the front surface. A range Y, a range M, and a range C represent combinations of heating times and heating temperatures for activating the first image forming layer 14, containing a yellow color material, the second image forming layer 16, containing a magenta color material, and the third image forming layer 18, containing a cyan color material, respectively.

According to the diagram, the yellow layer, which is the first image forming layer 14, develops its color in a case of receiving heat at a temperature of Ta3 or higher for a time of t1 or longer. The magenta layer, which is the second image forming layer 16, develops its color in a case of receiving heat at a temperature of Ta2 (<Ta3) or higher for a time of t2 (>t1) or longer. The cyan layer, which is the third image forming layer 18, generates its color in a case of receiving heat at a temperature of Ta1 (<Ta2<Ta3) or higher for a time of t3 (>t2>t1) or longer.

For example, heat at a temperature of Ta3 or higher may be applied for a time of t1 to t2 to any regions desired to develop only yellow. Heat at a temperature of Ta2 to Ta3 may be applied for a time of t2 to t3 to any regions desired to develop only magenta. Heat at a temperature of Ta1 to Ta2 may be applied for a time of t3 or longer to any regions desired to develop only cyan. By individually controlling the color development of each color element in the above manner, it is possible to express a color space formed of combinations of yellow, magenta, and cyan.

While Ta1, Ta2, and Ta3 are values adjusted on the basis of the materials contained in the image forming layers, it is generally preferable to set them within the range of approximately 90° C. to approximately 300° C. at appropriate intervals (temperature differences). For example, Ta1 is required to be as low a temperature as possible so as to prevent activation during shipment and storage, and is preferably approximately 100° C. On the other hand, Ta3 is required to be such a temperature that the second and third image forming layers, situated as lower layers, are not activated by short-time heat diffusion, and is preferably approximately 200° C. Ta2 is required to be a temperature that does not reach Ta1 or Ta3 even in the presence of a minor temperature change, and is preferably approximately 140° C. to approximately 180° C.

Figure 3A:
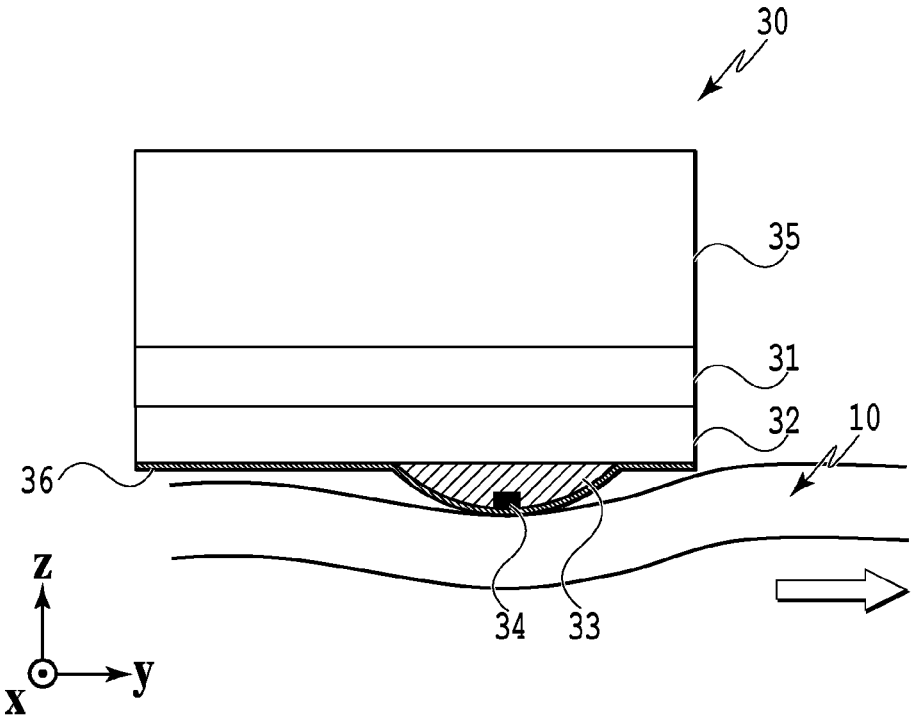
FIGS. 3A and 3B are diagrams for explaining a print head.
Figure 3B:
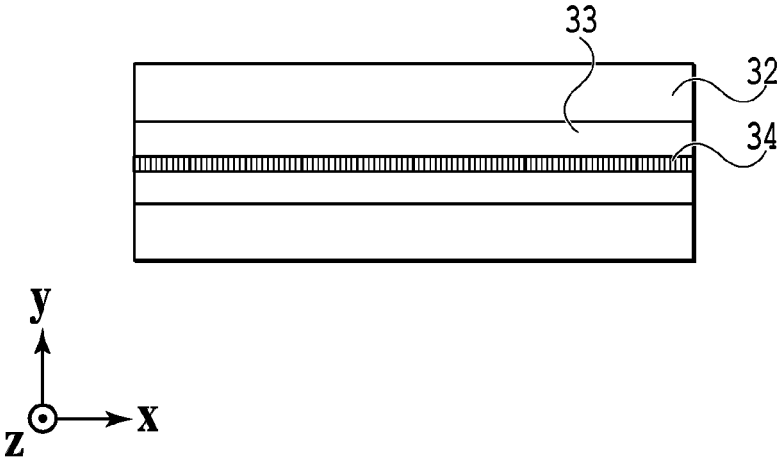

FIGS. 3A and 3B are views for explaining a print head 30 used in the present embodiment. FIG. 3A is a side view of the print head 30 in a state of performing a printing process on the print medium 10, while FIG. 3B is a plan view of the print head 30 as seen from the side to be brought into contact with the print medium 10.

As illustrated in FIG. 3A, a glaze 32 and a protruding surface glaze 33 of the same material as the glaze 32 are disposed on a base 31 of the print head 30, and heat generation elements 34 are disposed in the distal end of the protruding surface glaze 33. Also, a protection film 36 for protecting the glaze 32, the protruding surface glaze 33, and the heat generation elements 34 is disposed to cover their entire front surfaces. Note that the protruding surface glaze 33 is not an essential component, and the heat generation elements 34 may be disposed in the glaze 32, which is formed of a flat plate.

A heat sink 35 is provided on the opposite surface of the base 31 from the above members, and the entire print head is cooled with a fan.

The x direction illustrated in the drawings corresponds to the transverse direction (width direction) of the print medium 10, and the print medium 10 is conveyed in the y direction (longitudinal direction) at a predetermined speed while being in contact with the protruding surface glaze 33 and the heat generation elements 34 of the print head 30 through the protection film 36.

As illustrated in FIG. 3B, in the print head 30, the glaze 32 and the protruding surface glaze 33 extend in such a length in the x direction as to cover the width of the print medium 10, and the plurality of heat generation elements 34 are arrayed in the x direction in the protruding surface glaze 33. Each heat generation element 34 has a length of approximately 40 μm in the x direction and a length of approximately 120 μm in the y direction. While the print medium 10 is conveyed as in FIG. 3A, the print medium 10 is in contact with the protruding surface glaze 33, including the heat generation elements 34, across a distance of approximately 200 μm or longer.

Figure 4:
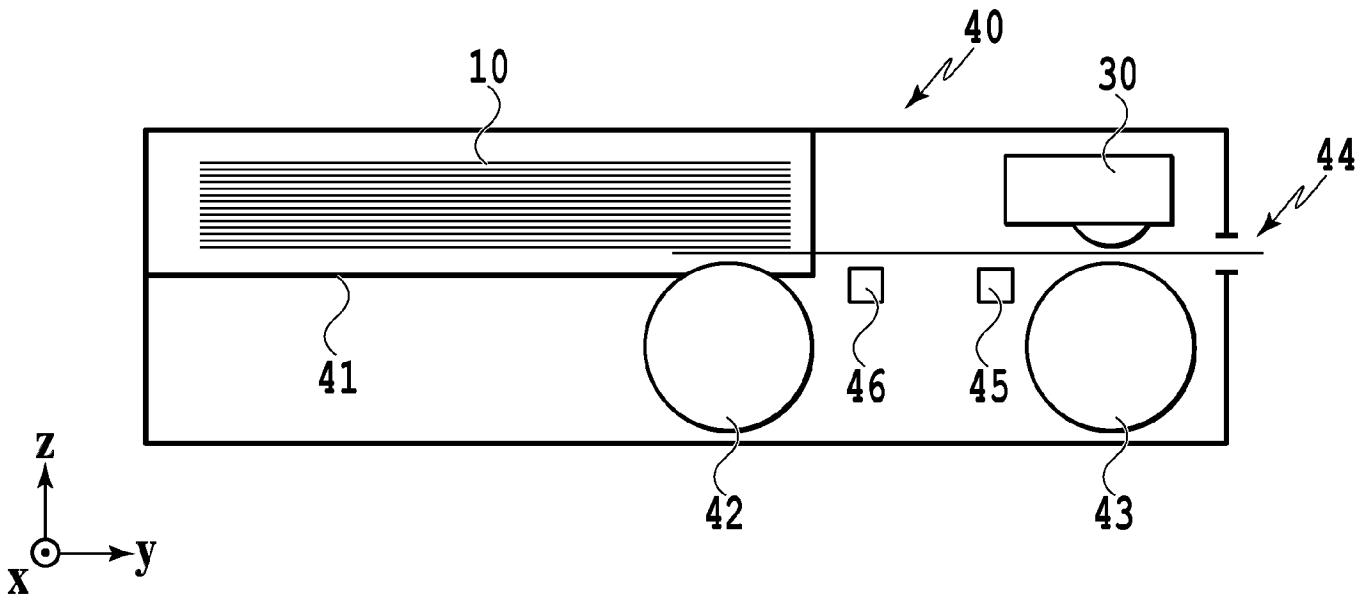
FIG. 4 is an internal configuration diagram of a printing apparatus used in a first embodiment.

FIG. 4 is an internal configuration diagram of a printing apparatus 40 used in the present embodiment. The x direction represents the width direction of the print medium 10, the y direction represents the direction of conveyance of the print medium, and the z direction represents the vertical direction. A plurality of print media 10 before printing are housed in a tray 41. Here, the print media 10 are piled with their front surfaces (the protection layer 13 side in FIG. 1) up (+z direction).

Upon receipt of a print job, a conveyance roller 42 rotates and conveys the print medium 10 located at the bottom in the y direction. As a result, the print medium 10 is sent to a printing zone where the print head 30 and a platen 43 are disposed. At the printing zone, the protruding surface glaze 33 of the print head 30 contacts the front surface of the conveyed print medium 10 while the platen 43 supports the back surface of the printed print medium 10. The heat generation elements 34 are driven in accordance with print data, and the print medium 10 develops colors depending on the heat applied by the heat generation elements 34. The print medium 10 printed by the print head 30 is discharged from a discharge port 44.

A temperature sensor 45 and a medium sensor 46 are provided on the conveyance path for the print medium 10. The temperature sensor 45 in the present embodiment is configured to detect the temperature of the back surface of the print medium 10, but may be configured to detect the temperature of the heat generation elements 34 or the glaze 32 of the print head 30 or the ambient temperature. Also, the temperature sensor 45 may be provided at a plurality of positions inside the apparatus. The medium sensor 46 detects the presence of a medium to determine whether the medium has been properly fed, and detects the type of the print medium.

Note that the size of each one-pixel region in the print medium 10 in the x direction is determined by the size of a heat generation element 34, and the size in the y direction is determined by the size of a heat generation element 34 and the speed of conveyance of the print medium 10. The size of each one-pixel region is not particularly limited. In the present embodiment, each one-pixel region covers approximately 40 μm in both the x direction and the y direction. In other words, pixels are arrayed at a density of approximately 600 dpi (dots/inch) in the print medium 10.

Figure 5:
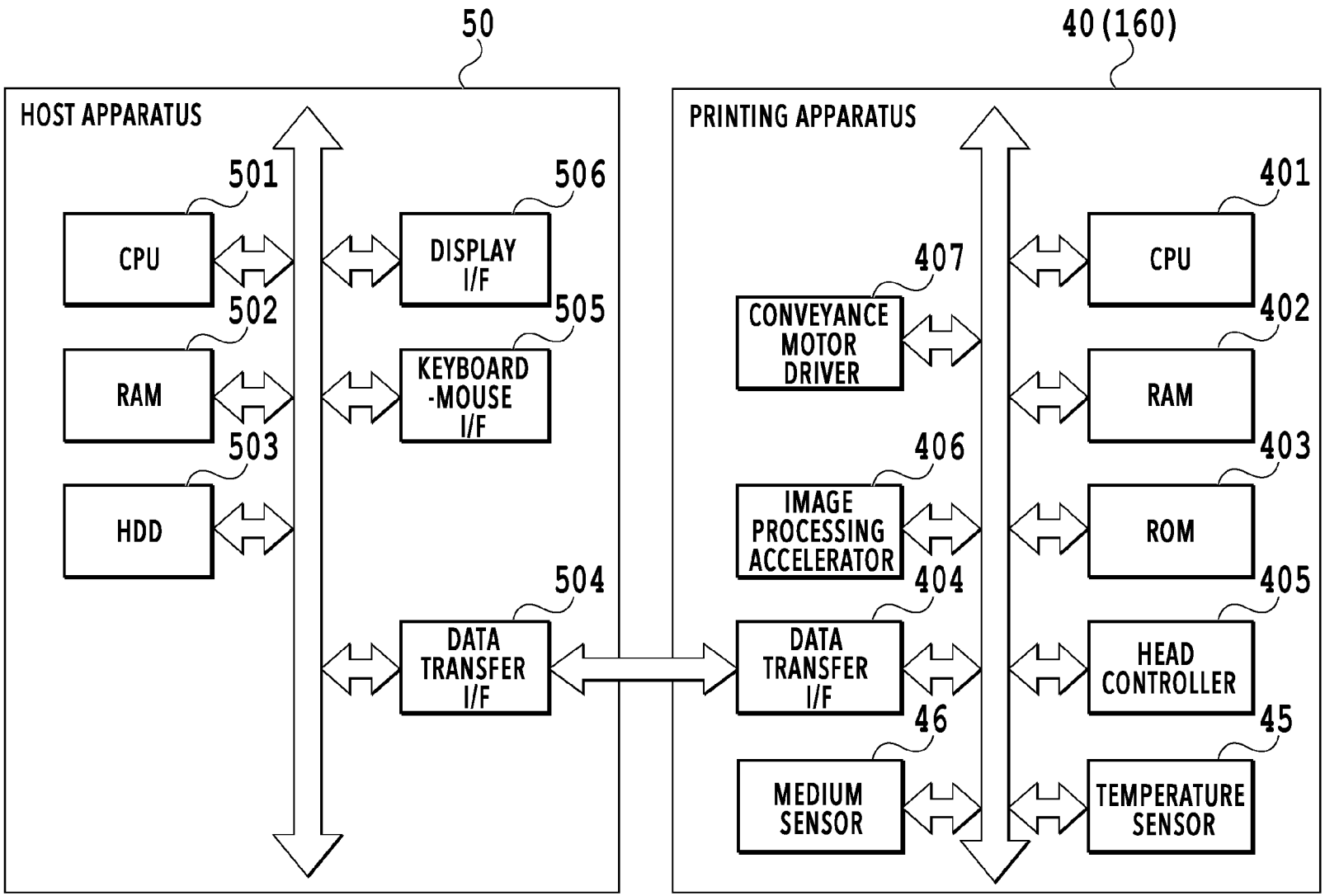
FIG. 5 is a block diagram for explaining a configuration for control in a printing system.

FIG. 5 is a block diagram for explaining a configuration for control in a printing system in the present embodiment formed of the printing apparatus 40 and a host apparatus 50. The host apparatus 50 can be a general personal computer, a smartphone, a digital camera, or the like.

In the host apparatus 50, a CPU 501 executes processes following programs held in an HDD 503 and an RAM 502. The RAM 502 is a volatile storage and temporarily holds programs and data. Also, the HDD 503 is a non-volatile storage and, likewise, holds programs and data.

A data transfer interface (I/F) 504 controls transmission and reception of data to and from the printing apparatus 40. Wired connection such as USB, IEEE1394, or LAN or wireless connection such as Bluetooth (registered trademark) or WiFi is usable as the connection scheme for the data transmission and reception.

A keyboard-mouse I/F 505 is an I/F that controls human interface devices (HIDs) such as a keyboard and a mouse, and the user can configure various settings through this I/F. A display I/F 506 controls display on a display for providing information to the user. Note that the HIDs and the display can be a touchscreen integrating their functions.

On the other hand, in the printing apparatus 40, a CPU 401 executes later-described various processes by following programs held in an ROM 403 and an RAM 402. The RAM 402 is a volatile storage and temporarily holds programs and data. Also, the ROM 403 is a non-volatile storage and holds table data and programs to be used in the later-described various processes. For example, on the basis of the results of detections by the temperature sensor 45 and the medium sensor 46, the CPU 401 selects a set of control tables and control parameters suitable for a printing process from among a plurality of sets of control tables and control parameters stored in the ROM 403 and deploys it to the RAM 402.

A data transfer I/F 404 controls transmission and reception of data to and from the host apparatus 50. For example, upon receipt of a print job from the host apparatus 50, the data transfer I/F 404 is instructed by the CPU 401 to deploy image data contained in the print job to the RAM 402.

A head controller 405 drives the individual heat generation elements 34, arrayed in the print head 30, by following instructions from the CPU 401. Specifically, as the CPU 401 writes control parameters and print data to predetermined addresses in the RAM 402, the head controller 405 reads out the control parameters and the print data and drives the heat generation elements 34 in accordance with them.

A conveyance motor driver 407 drives a conveyance motor that rotates the conveyance roller 42, illustrated in FIG. 4, by following instructions from the CPU 401.

An image processing accelerator 406 is configured as hardware and executes image processing at higher speed than the CPU 401 does. Specifically, as the CPU 401 deploys parameters and data necessary for image processing to predetermined addresses in the RAM 402, the image processing accelerator 406 is booted and executes later-described predetermined image processing. Note that the image processing accelerator 406 is not an essential element in the present embodiment. The configuration may be such that the CPU 401 executes the above predetermined image processing.

Figure 6:
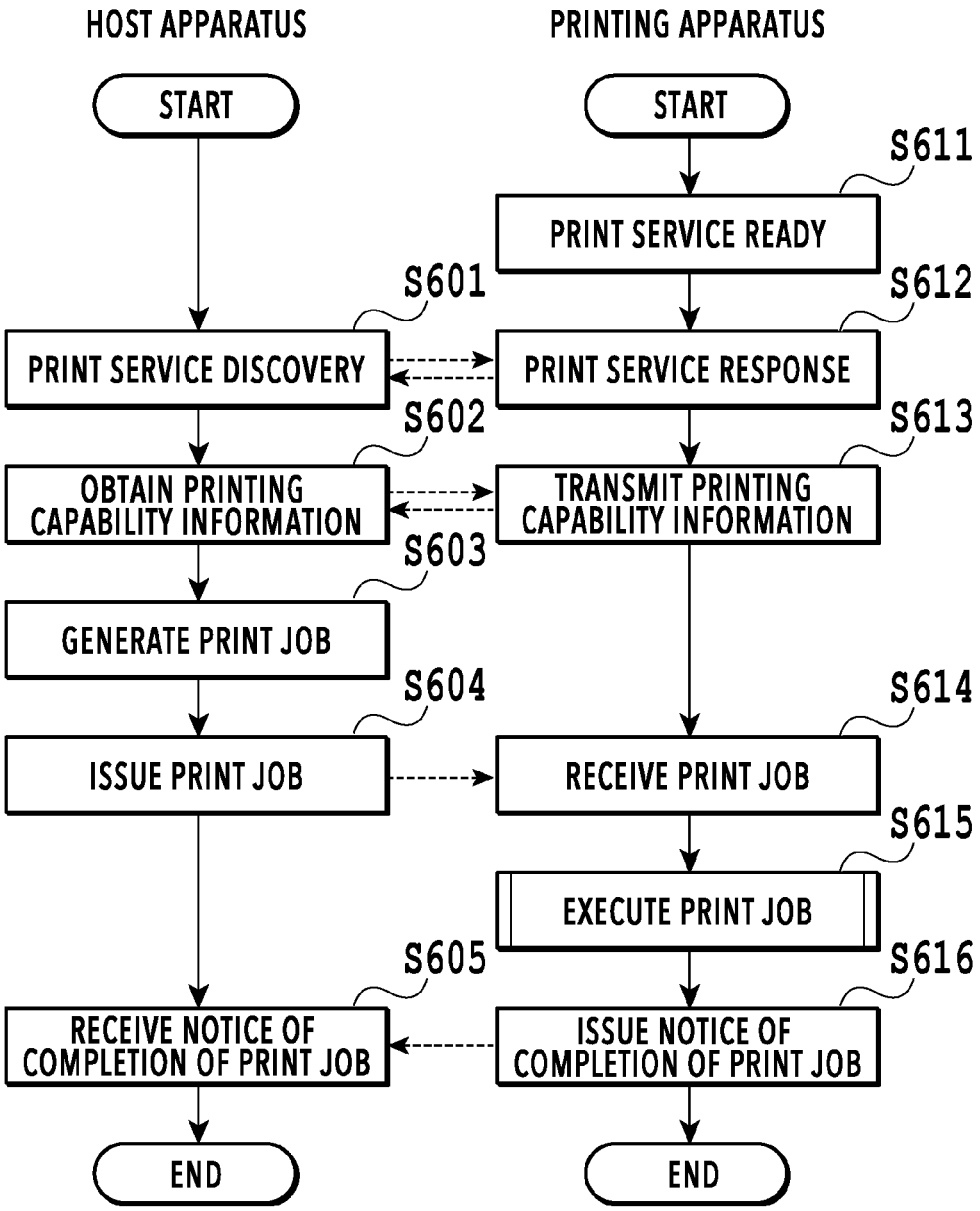
FIG. 6 is a flowchart for explaining a print service providing process.

FIG. 6 is a flowchart for explaining the flow of processing in a print service providing process. The series of processes is executed in the host apparatus 50 by the CPU 501 with the RAM 502 as a work area and executed in the printing apparatus 40 by the CPU 401 with the RAM 402 as a work area. In the following, the CPU 501 of the host apparatus 50 will be referred to as the host CPU 501, and the CPU 401 of the printing apparatus 40 will be referred to as the printer CPU 401 for convenience of description.

It is assumed that the printing apparatus 40 has already been powered on and is in a print service standby state in S611. This processing is started upon issuing of a print service discovery from the host apparatus 50 in S601.

As the data transfer I/F 404 of the printing apparatus 40 receives the print service discovery, the printer CPU 401 sends a response indicating that the printing apparatus 40 is capable of providing a print service, again through the data transfer I/F 404 (S612).

By receiving this response, the host CPU 501 acknowledges the printing apparatus 40 as a printer for implementing the print service. In S602, the host CPU 501 accesses the printing apparatus 40 and obtains unique printing capability information on the printing apparatus. Upon receipt of a request from the host apparatus 50, the printer CPU 401 provides unique information on the printing apparatus such as the print resolution, the print sizes, whether the printing apparatus is a color printer or a monochrome printer, and so on. The information may also contain the type of the currently loaded print media or the like, for example. The host CPU 501 creates a user interface on the basis of the obtained printing capability information and displays the printing capability information on the display to obtain authorization from the user. Here, in a case where the printing apparatus 40 has a plurality of providable print modes, the user may select a print mode which the user prefers.

In S603, the host CPU 501 generates a print job on the basis of the obtained printing capability information and the information on the mode set by the user. Specifically, the host CPU 501 combines various set pieces of information and image data to be printed and arrange them in such a data format that they can be transmitted to the printing apparatus 40, to obtain the resultant data as a print job.

In S604, the host CPU 501 issues the print job generated in S603, and the printer CPU 401 receives this (S614). The job data transmitted here from the host apparatus 50 to the printing apparatus 40 may be in a compressed state.

In S615, the printer CPU 401 executes the print job. Specifically, using the image processing accelerator 406, predetermined image processing is performed on the image data deployed to the RAM 402 to generate print data printable by the print head 30. Then, a printing process is executed on the print medium 10 by using the head controller 405 and the conveyance motor driver 407.

After the series of operations in the print job is completed, the printer CPU 401 issues a notice indicating that the print job has been finished (S616). The host CPU 501 receives this and notifies the user with the display that the print service has been completed (S605). By the above step, the series of operations in the print service providing process ends.

In the above, a so-called pull-type communication configuration has been exemplarily described in which the host apparatus 50 sends a request and the printing apparatus 40 responds. Note, however, that a push-type communication configuration may be used in which the printing apparatus 40 requests a plurality of host apparatuses present in a network for a job.

Figure 7:
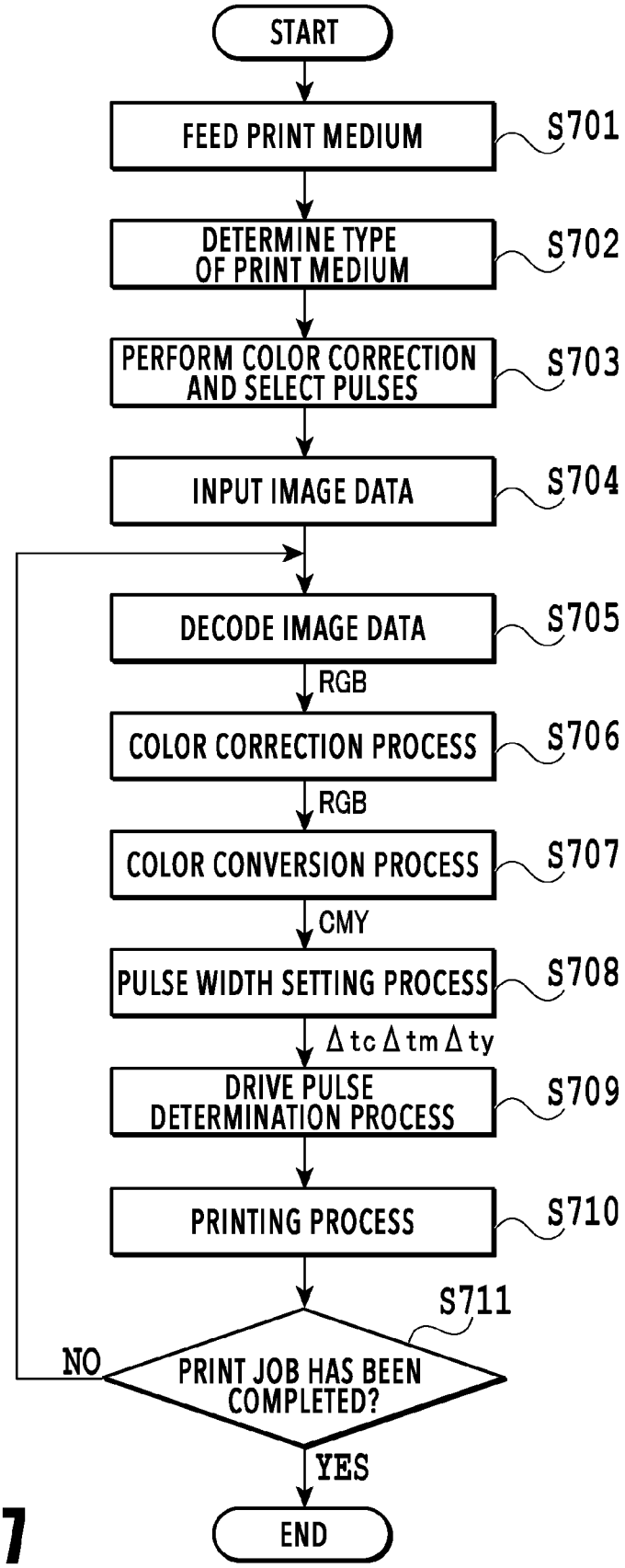
FIG. 7 is a flowchart for explaining a print job execution sequence.

FIG. 7 is a flowchart for explaining a print job execution sequence executed by the printer CPU 401 in S615. Upon start of this processing, firstly in S701, the printer CPU 401 performs an operation to feed a print medium 10. Specifically, the printer CPU 401 rotates the conveyance roller 42 with the conveyance motor driver 407 to convey the print medium 10 housed at the bottom in the tray 41 in the y direction to the printing zone.

In S702, the printer CPU 401 determines the presence and type of the conveyed print medium 10 on the basis of detection data from the medium sensor 46. The tray 41 of the printing apparatus 40 is capable of housing any of the above-described first print medium, a second print medium, and a third print medium, and the conveyance roller 42 is capable of conveying any of these print media. On the back surface of each individual print medium 10 is recorded a symbol that indicates the type of the print medium, such as a one-dimensional barcode or a two-dimensional barcode. The printer CPU 401 determines the type of the print medium 10 on the basis of the symbol read by the medium sensor 46, which is an optical sensor. Note that the symbol recorded on the back surface of the print medium may be magnetic information, in which case the medium sensor 46 is a magnetic sensor. The print medium types usable in the present embodiment will be specifically described later.

In S703, the printer CPU 401 obtains a color correction table, a color conversion table, a pulse width table, and a drive timing table for the type of the print medium determined in S702. In the ROM 403, sets of these tables are stored in advance in association with a plurality of print medium types. From among these sets of tables, the printer CPU 401 selects the tables associated with the type of the print medium one by one and deploys them to the RAM 402. These tables and parameters will be specifically described later.

In S704, the printer CPU 401 deploys the image data received in S614 to the RAM 402 so that the image processing accelerator 406 can process it. The image data deployed here may be compressed data or encoded data.

In S705, the printer CPU 401 decodes the data of a single page in the compressed or encoded data deployed to the RAM 402. The decoded image data is formed of three types of multivalued data (R, G, B) adapted to color elements of red (R), green (G), and blue (B). In the case where the data is not compressed or encoded, the above multivalued data (R, G, B) is deployed to the RAM 402 in S704. While the format of the multivalued data (R, G, B) is not particularly limited, it is preferably a standard color format such as sRGB or adobe RGB. While the number of tones in the multivalued data is not limited either, the multivalued data has 8-bit, 255 tones for each color in the present embodiment.

In S706, the printer CPU 401 performs a color correction process by using the color correction table set in S703. As a result, the (R, G, B) color space in the standard color format, such as sRGB or adobe RGB, is transformed into a color space (R', G', B') adapted to the combination of the printing apparatus 40 and the selected print medium type.

Figure 9A:
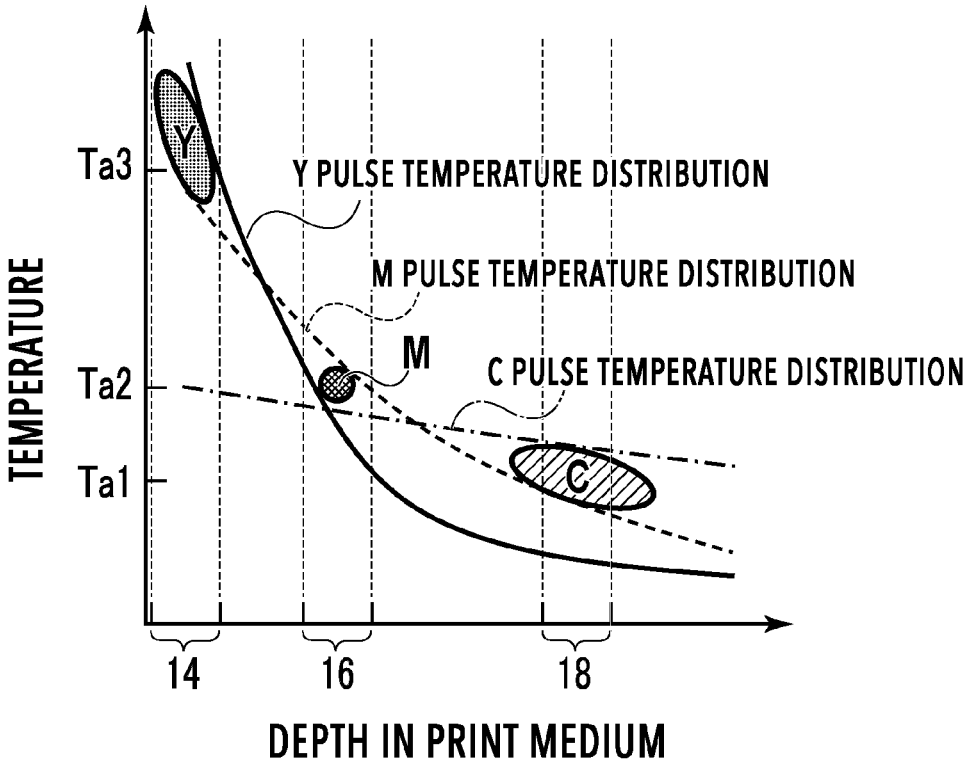
FIGS. 9A and 9B are diagrams illustrating print characteristics of the first print medium.
Figure 9B:
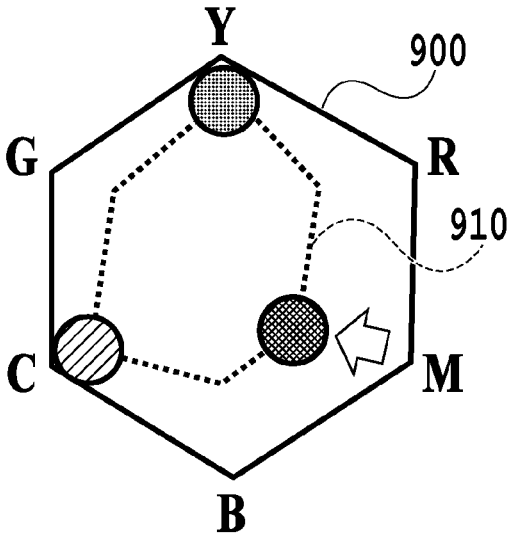

FIG. 9B is a diagram for comparing a color reproduction range 900 in the standard format before the color correction and a color reproduction range 910 after the color correction. Illustrated here is a diagram obtained by projecting a general L*a*b* space onto an a*b* plane. The color reproduction range 910, which is determined by the combination of the printing apparatus 40 and the print medium 10, is a smaller than the color reproduction range 900 in the standard format, which assumes monitor display. In the color correction process in S706, the printer CPU 401 associates color signals (R, G, B) in the standard format with color signals (R', G', B') for the printing apparatus while taking into account reduction in size of the color space as above.

In the present embodiment, the above-mentioned color correction table is stored in advance in the ROM 403 as a three-dimensional lookup table in association with the type of the print medium. The printer CPU 401 converts the 8-bit (R, G, B) data into 8-bit (R', G', B') data by using the color correction table read out and deployed to the RAM 402 in S703.

$$R'=3D_LUT[R][G][B][0]$$

$$G'=3D_LUT[R][G][B][1]$$

$$B'=3D_LUT[R][G][B][2]$$

In S707, the printer CPU 401 executes a color conversion process. Specifically, the printer CPU 401 converts the (R', G', B') multivalued luminance data into (C, M, Y) multivalued density data corresponding to the development color of the image forming layers in the print medium. In a case where the (R', G', B') multivalued luminance data and the (C, M, Y) multivalued density data are both 8-bit (256-tone) data, the color conversion process can use the conversion equations below, for example.

$$C=255-R$$

$$M=255-G$$

$$Y=255-B$$

Note that the development color of the image forming layers in the print medium (C, M, Y) and the color of the input luminance data (R', G', B') are not always in a completely complementary color relation. In many cases, expressing any of red (R), green (G), and blue (B) usually involves mixing the cyan (C), magenta (M), and yellow (Y) color materials. For this reason, in the present embodiment, a three-dimensional lookup table for converting the 8-bit (R', G', B') data into 8-bit (C, M, Y) data is prepared in advance also for the color conversion process, as in the color correction process.

$$C=3D_LUT[R'][G'][B'][0]$$

$$M=3D_LUT[R'][G'][B'][1]$$

$$Y=3D_LUT[R'][G'][B'][2]$$

Note that each tone value (level) in the (C, M, Y) data obtained by the color conversion process in S707 does not have to be 256 tones, which is the same number of tones as the (R', G', B') data, but may be a smaller number of tones expressible by the printing apparatus. For example, in a case where the number of tones expressible by the printing apparatus is 17 from level 0 to level 16, the above color conversion table may be a lookup table that converts 8-bit (R', G', B') data into 4-bit (C, M, Y) data. In this case, the memory for storing the table is small as compared to the case of preparing grid points for 256 tones. Also, after converting the 8-bit (R', G', B') data into 4-bit (C, M, Y) data (17 tones) by using a table with a smaller number of grid points, the 4-bit, 17-tone data may be expanded to 8-bit 256-tone data by using publicly known tetrahedral interpolation computation or the like.

In S708, the printer CPU 401 performs a pulse width setting process by using the pulse width table deployed to the RAM 402 in S703. Here, the pulse width table is a set of one-dimensional lookup tables in which a cyan pulse width Δtc, a magenta pulse width Δtm, and a yellow pulse width Δty of voltage pulses to be applied to the heat generation elements 34 are stored in association with signal values (C, M, Y), respectively.

$$\Delta tc=1D_LUT[C]$$

$$\Delta tm=1D_LUT[M]$$

$$\Delta ty=1D_LUT[Y]$$

In such a pulse width table, the individual pulse widths (Δtc, Δtm, Δty) are set on the basis of maximum Δty_max, Δtm_max, and Δty_max applied to the heat generation elements 34 in a case where the input signal value is MAX (=255). Moreover, these maximum pulse widths Δty_max, Δtm_max, and Δty_max are values varied according to the type of the print medium.

In other words, in S708, the printer CPU 401 converts the multivalued density data (C, M, Y) into pulse width data (Δtc, Δtm, Δty) by using the pulse width table for the type of the print medium.

In doing so, the printer CPU 401 may correct (Δtc, Δtm, Δty) obtained from the table on the basis of the temperature detected by the temperature sensor 45. For example, in a case where the temperature of the print medium 10 or the print head 30 is higher than the usual temperature, then, applying voltages with the pulse widths obtained from the table causes regions in the print medium to reach higher temperatures than the target temperature. Accordingly, the print medium may possibly be printed at higher densities than necessary or in different hues. For this reason, in the case where the temperature of the print medium 10 or the print head 30 is higher than the usual temperature, it is preferable to perform a correction that narrows the pulse widths (Δtc, Δtm, Δty) obtained from the table. On the other hand, in a case where the temperature of the print medium 10 or the print head 30 is lower than the usual temperature, it is preferable to perform a correction that widens the pulse widths (Δtc, Δtm, Δty) obtained from the table. Also, in a case where the temperature detected by the temperature sensor 45 is so high or low that it cannot be corrected by the pulse width adjustment, it is possible not to proceed to the next step but wait or heat the print medium 10 or the print head 30 until the detected temperature reaches a predetermined range.

In S709, the printer CPU 401 executes a drive pulse determination process by using the drive timing table deployed to the RAM 402 in S703.

Figure 8:
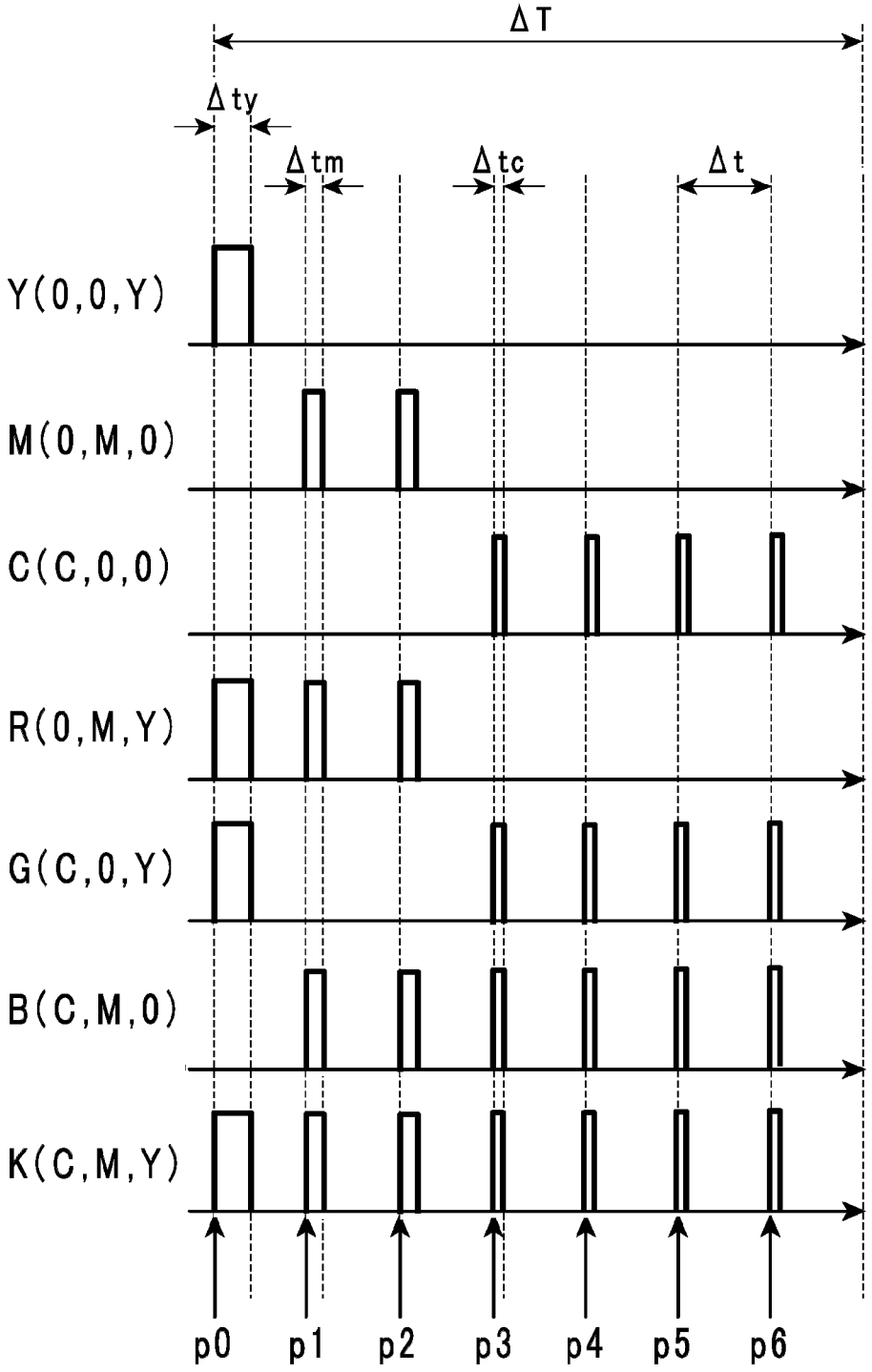
FIG. 8 is a diagram illustrating an example of drive pulses for the first print medium.

FIG. 8 is a diagram illustrating an example of the drive pulses determined in the drive pulse determination process in S709. Each row represents a timing chart of a voltage pulse(s) to be applied to a heat generation element 34 to express the corresponding color indicated on the left side at a one-pixel region. In the timing chart, the horizontal axis represents the time while the vertical axis represents the voltage.

ΔT is a time allocated for color formation at a one-pixel region, and is equal to the time taken for the conveyance roller to convey the print medium 10 a one-pixel distance (40 μm). Δt is equal to the time obtained by equally dividing ΔT by seven, and timings p0 to p6 spaced at intervals of Δt represent seven pulse application start timings prepared for expressing a color at a single pixel. In the present embodiment, the drive timing table selected in S703 is a table defining the associations between the timings p0 to p6 and the pulses (Δtc, Δtm, Δty). Such associations (i.e., drive timing table) vary depending on the type of the print medium.

The drive pulses illustrated in FIG. 8 are drive pulses for the first print medium, and the contents of the drive timing table therefor are set as follows.

p0→Δty
p1→Δtm
p2→Δtm
p3→Δtc
p4→Δtc
p5→Δtc
p6→Δtc

Specifically, with the above drive timing table, it is determined that a pulse with the pulse width Δty is to be applied at the timing p0, a pulse with the pulse width Δtm is to be applied at the timings p1 and p2, a pulse with the pulse width Δtc is to be applied at the timings p3, p4, p5, and p6. Thus, in S709, the printer CPU 401 determines the drive pulse(s) (print data) for each individual pixel by using the drive timing table for the type of the print medium and the pulse width data (Δtc, Δtm, Δty) set in S708.

In the present embodiment, the voltage value of the voltage pulse(s) to be applied to each heat generation element 34 is fixed while the pulse width and the frequency of application are varied to express various colors. Further, basically, the applied heat temperature illustrated in FIG. 2 is adjusted by the pulse width while the heat application time illustrated in FIG. 2 is adjusted by the frequency of application of a pulse.

For example, the temperature range not lower than Ta3 illustrated in FIG. 2 for activating the yellow image forming layer 14 can be achieved using the yellow pulse width Δty ($0<\Delta ty<\Delta ty_max$) illustrated in FIG. 8. Also, the applied heat temperature range of Ta2 to Ta3 for activating the magenta image forming layer 16 can be achieved using the pulse width Δtm ($0<\Delta tm<\Delta tm_max$) illustrated in FIG. 8. Further, the applied heat temperature range of Ta1 to Ta2 for activating the cyan image forming layer 18 can be achieved using the pulse width Δtc ($0<\Delta tc<\Delta tc_max$) illustrated in FIG. 8.

Meanwhile, the heat application time t1 illustrated in FIG. 2 is achieved by applying a predetermined pulse once. Also, the heat application time t2 (>t1) is achieved by applying a predetermined pulse twice at a periodic interval of Δt, and the heat application time t3 (>t2>t1) is achieved by applying a predetermined pulse four times at periodic intervals of Δt. Basically, $\Delta ty_max=\Delta tm_max\times 2=\Delta tc_max\times 4$ holds. For the activation of any of the image forming layers, the total duration (energy) of the pulse(s) applied to a heat generation element 34 is nearly equal.

The timing charts for the colors in FIG. 8 will be described in turn below. For example, image data after the color conversion process for expressing a single color of yellow is (C=0, M=0, Y>0). In this case, a pulse with the pulse width Δty is applied once at the timing p0, and no other pulses are applied. Image data for expressing a single color of magenta is (C=0, M>0, Y=0). In this case, a pulse with the pulse width Δtm is applied at the timings p1 and p2, and no other pulses are applied. Image data for expressing a single color of cyan is (C>0, M=0, Y=0). In this case, a pulse with the pulse width Δtc is applied at the timings p3, p4, p5, and p6, and no other pulses are applied.

Image data for expressing red is (C=0, M>0, Y>0). In this case, a pulse with the pulse width Δty is applied at the timing p0, and a pulse with the pulse width Δtm is applied at the timings p1 and p2. Image data for expressing green is (C>0, M=0, Y>0). In this case, a pulse with the pulse width Δty is applied at the timing p0, and a pulse with the pulse width Δtc is applied at the timings p3, p4, p5, and p6. Image data for expressing blue is (C>0, M>0, Y=0). In this case, a pulse with the pulse width Δtm is applied at the timings p1 and p2, and a pulse with the pulse width Δtc is applied at the timings p3, p4, p5, and p6.

Further, image data for expressing black (achromatic color) is (C>0, M>0, Y>0). In this case, a pulse with the pulse width Δty is applied at the timing p0, a pulse with the pulse width Δtm is applied at the timings p1 and p2, and further a pulse with the pulse width Δtc is applied at the timings p3, p4, p5, and p6.

As described above, in the drive pulse determination process in S709 in FIG. 7, the printer CPU 401 sets the pulses (Δtc, Δtm, Δty) set in S708 to the timings p0 to p6 in accordance with the drive timing table set in S703. As a result, print data (drive pulse(s)) is generated for each individual pixel.

Referring back to the flowchart in FIG. 7, in S710, the printer CPU 401 executes a printing process in accordance with the print data generated in S709. Specifically, the printer CPU 401 conveys the print medium with the conveyance motor driver 407 while driving the heat generation elements 34, arrayed in the print head 30, in accordance with the print data generated in S709. As a result, at the individual pixel regions in the print medium, colors are expressed which correspond to the three-color density signals (C, M, Y) generated in the color conversion process.

In S711, the printer CPU 401 determines whether the print job has been completed. If there is image data remaining to be printed, the printer CPU 401 returns to S705 and continues the processing for the next page. On the other hand, if determining in S711 that the print job has been completed, the printer CPU 401 terminates this processing.

As described above, the printing apparatus in the present embodiment is capable of printing a full-color image on a print medium including a laminate of a plurality of image forming layers differing from each other in activation temperature, by driving the heat generation elements while adjusting the pulse width and the frequency of application.

Next, a plurality of print medium types printable by the printing apparatus 40 in the present embodiment will be described. FIG. 9A is a diagram illustrating the correlations between the position in the first print medium in the depth direction and its temperature obtained by applying a Y pulse, M pulses, and C pulses to the front surface of the print medium, respectively. Here, the Y pulse represents a pulse following the timing chart in the top row in FIG. 8 (applying a pulse with Δty at p0 and applying no other pulses). The M pulses represent pulses following the timing chart in the second row in FIG. 8 (applying a pulse with Δtm at p1 and p2 and applying no other pulses). The C pulses represent pulses following the timing chart in the third row in FIG. 8 (applying a pulse with Δtc at p3, p4, p5, and p6 and applying no other pulses).

In the diagram, the horizontal axis represents the depth position in the print medium 10 from its front surface. In this diagram, the positions of the first to third image forming layers are indicated as well. Also, the vertical axis represents the temperature. Further, the temperature distribution as a result of applying the Y pulse is indicated as "Y pulse temperature distribution", the temperature distribution as a result of applying the M pulses is indicated as "M pulse temperature distribution", and the temperature distribution as a result of applying the C pulses is indicated as "C pulse temperature distribution".

In the range where the first image forming layer 14 is located, the "Y pulse temperature distribution" is above the activation temperature Ta3 of the first image forming layer 14. Thus, any region in the first image forming layer 14 activated by applying the Y pulse develops yellow. On the other hand, in the range where the second image forming layer 16 is located, the "Y pulse temperature distribution" is not above the activation temperature Ta2 of the second image forming layer 16. Also, in the range where the third image forming layer 18 is located, the "Y pulse temperature distribution" is not above the activation temperature Ta1 of the third image forming layer 18. Thus, in the case where the Y pulse is applied, neither the second image forming layer 16 nor the third image forming layer 18 is activated, so that neither magenta nor cyan is developed. The Y pulse is therefore a drive pulse capable of activating only the first image forming layer 14.

Also, in the range where the second image forming layer 16 is located, the "M pulse temperature distribution" is above the activation temperature Ta2 of the second image forming layer 16. Thus, any region in the second image forming layer 16 activated by applying the M pulses develops magenta. On the other hand, in the range where the first image forming layer 14 is located, the "M pulse temperature distribution" is not above the activation temperature Ta3 of the first image forming layer 14. Also, in the range where the third image forming layer 18 is located, the "M pulse temperature distribution" is not above the activation temperature Ta1 of the third image forming layer 18. Thus, in the case where the M pulses are applied, neither the first image forming layer 14 nor the third image forming layer 18 is activated, so that neither yellow nor cyan is developed. The M pulses are therefore drive pulses capable of activating only the second image forming layer 16.

Further, in the range where the third image forming layer 18 is located, the "C pulse temperature distribution" is above the activation temperature Ta1 of the third image forming layer 18. Thus, any region in the third image forming layer 18 activated by applying the C pulses develops cyan. On the other hand, in the range where the first image forming layer 14 is located, the "C pulse temperature distribution" is not above the activation temperature Ta3 of the first image forming layer 14. Also, in the range where the second image forming layer 16 is located, the "C pulse temperature distribution" is not above the activation temperature Ta2 of the second image forming layer 16. Thus, in the case where the C pulses are applied, neither the first image forming layer 14 nor the second image forming layer 16 is activated, so that neither yellow nor magenta is developed. The C pulses are therefore drive pulses capable of activating only the third image forming layer 18.

Thus, the Y pulse, the M pulses, and the C pulses can be used to individually generate yellow, magenta, and cyan, respectively. Moreover, by individually adjusting the pulse widths Δty, Δtm, and Δtc, the first print medium can generate colors included in the first color reproduction range 910 illustrated in FIG. 9B.

Meanwhile, according to FIG. 9A, a range (M) for the second image forming layer 16, which can be activated with the M pulses, is smaller than a range (Y) for the first image forming layer 14, which can be activated with the Y pulse, and a range (C) for the third image forming layer 18, which can be activated with the C pulses. This is because for the M pulses, the allowable pulse width and allowable number of pulses for activating only the second image forming layer 16 have stricter upper and lower limit values than those the Y pulse and the C pulses. For example, if the pulse width Δtm is widened to improve the degree of development of magenta, there is a possibility that the first image forming layer 14 and the third image forming layer 18 are also activated and develop yellow and cyan.

In this case, the second image forming layer 16 fails to be sufficiently activated as compared to the first and third image forming layers. The result is a color reproduction range in which, as illustrated in FIG. 9B, the color development range around magenta is narrower than the other hues' color development ranges. Specifically, the first print medium can generate good colors for images that do not use magenta to a great extent, such as images of clouds and grassland, but may fail to generate colors expected by the user for images that use magenta to a great extent, such as images of autumn leaves.

In view of such circumstances, in the present embodiment, a second print medium and a third print medium each containing a non-magenta color material in its second image forming layer 16 are prepared in addition to the first print medium, which has the color development conditions illustrated in FIG. 2. Specifically, referring again to FIG. 1, a print medium containing a yellow color material in the first image forming layer 14, a cyan color material in the second image forming layer 16, and a magenta color material in the third image forming layer 18 is prepared as the second print medium. Also, a print medium containing a magenta color material in the first image forming layer 14, a yellow color material in the second image forming layer 16, and a cyan color material in the third image forming layer 18 is prepared as the third print medium.

Figure 10:
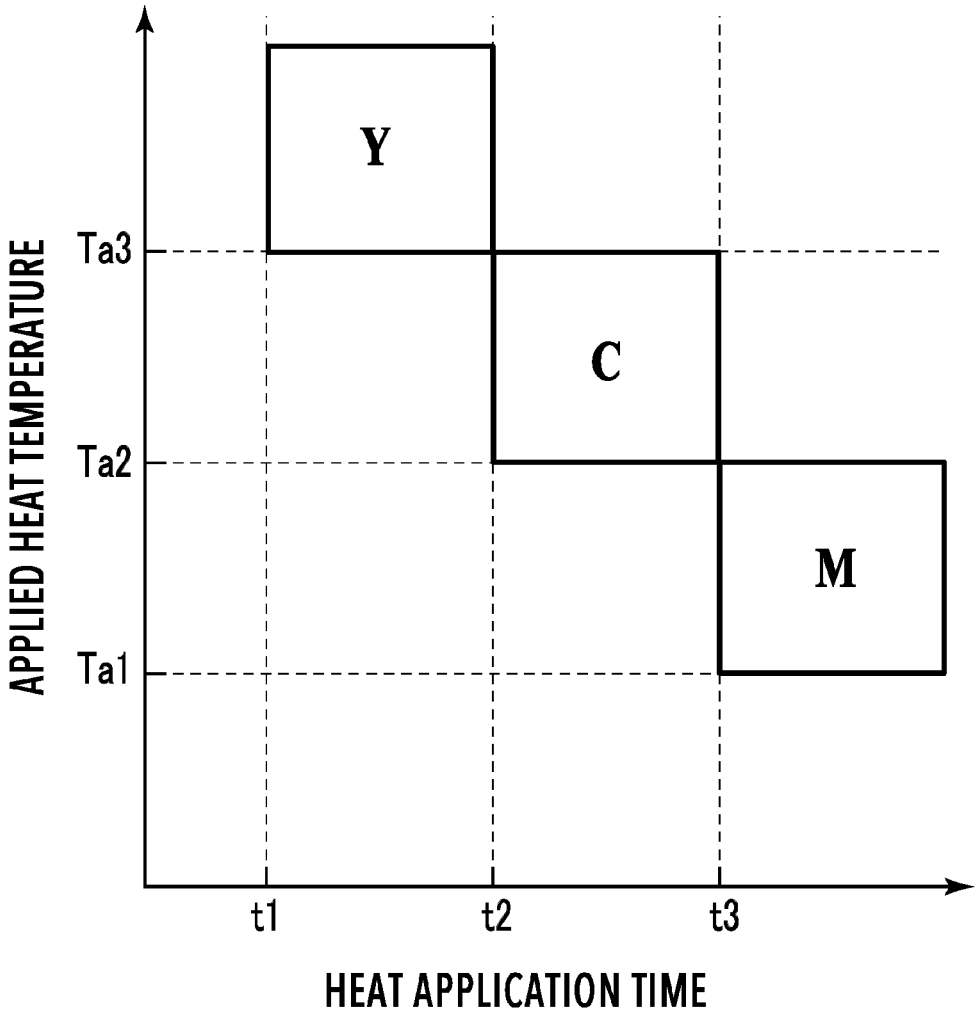
FIG. 10 is a diagram for explaining color development conditions for a second print medium.
Figure 13:
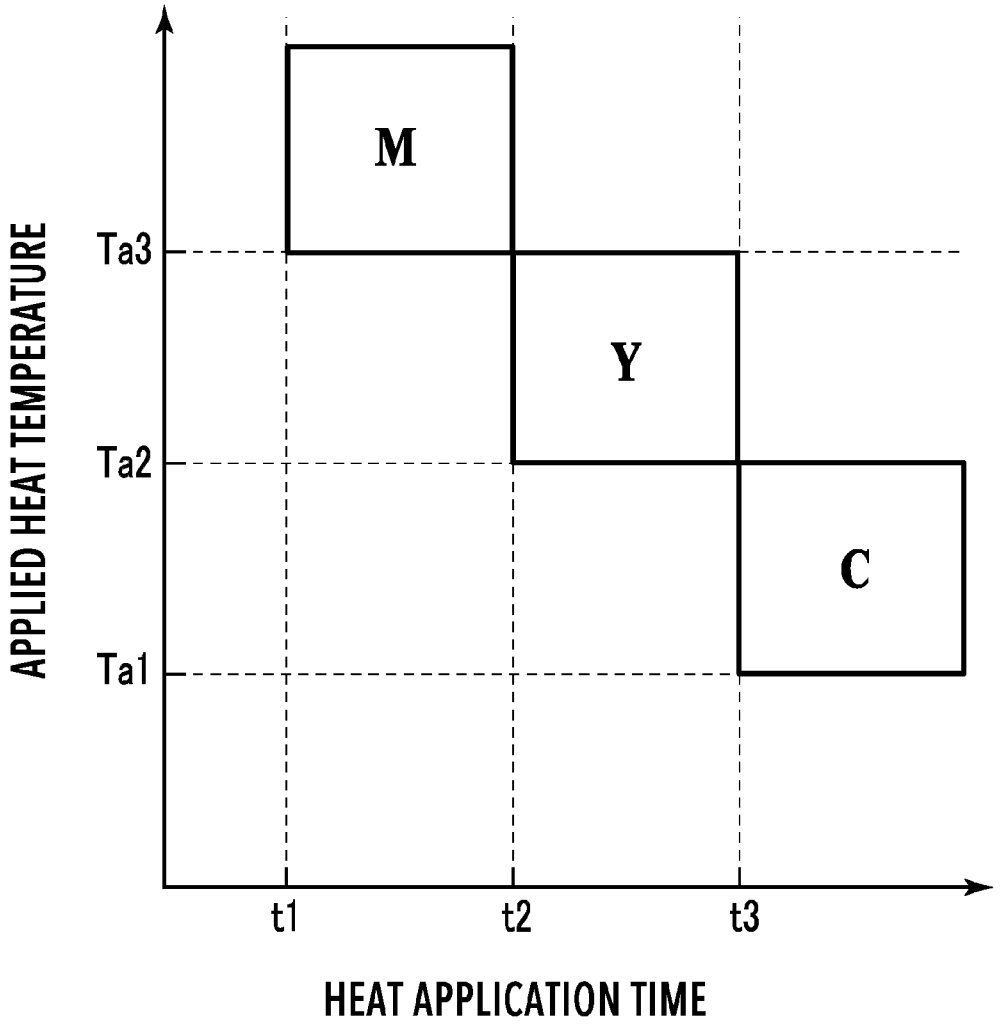
FIG. 13 is a diagram for explaining color development conditions for a third print medium.

FIGS. 10 and 13 are diagrams for comparing the color development conditions for the second and third print media and the color development conditions for the first print medium illustrated in FIG. 2. The second print medium, represented in FIG. 10, differs from the first print medium in that the range M and the range C are switched. In other words, in the second print medium, the yellow layer, which is the first image forming layer 14, develops its color in a case of receiving heat at a temperature of Ta3 or higher for a time of t1 or longer. The cyan layer, which is the second image forming layer 16, develops its color in a case of receiving heat at a temperature of Ta2 (<Ta3) or higher for a time of t2 (>t1) or longer. The magenta layer, which is the third image forming layer 18, develops its color in a case of receiving heat at a temperature of Ta1 (<Ta2<Ta3) higher for a time of t3 (>t2>t1) or longer.

On the other hand, the third print medium, represented in FIG. 13, differs from the first print medium in that the range M and the range Y are switched. In other words, in the second print medium, the magenta layer, which is the first image forming layer 14, develops its color in a case of receiving heat at a temperature of Ta3 or higher for a time of t1 or longer. The yellow layer, which is the second image forming layer 16, develops its color in a case of receiving heat at a temperature of Ta2 (<Ta3) or higher for a time of t2 (>t1) or longer. The cyan layer, which is the third image forming layer 18, develops its color in a case of receiving heat at a temperature of Ta1 (<Ta2<Ta3) or higher for a time of t3 (>t2>t1) or longer.

In the case where a plurality of print medium types as above are prepared, the maximum pulse widths Δtc_max, Δtm_max, and Δty_max for the respective colors are varied according to the print medium type.

In the first print medium, $$\Delta ty_\max > \Delta tm_\max > \Delta tc_\max.$$

However, in the second print medium, $$\Delta ty_\max > \Delta tc_\max > \Delta tm_\max.$$

In the third print medium, $$\Delta tm_max > \Delta ty_max > \Delta tc_max.$$

For this reason, the pulse width table to be used in S708 also needs to be prepared according to the type of the print medium, and the pulse widths (Δtc, Δtm, Δty) for the individual pixels also need to be set by using the pulse width table for the type of the print medium.

Also, in the present embodiment, the drive timing table is prepared according to the type of the print medium. The contents of the drive timing table for the second print medium are set as follows.

p0→Δty
p1→Δtc
p2→Δtc
p3→Δtm
p4→Δtm
p5→Δtm
p6→Δtm

The contents of the drive timing table for the third print medium are set as follows.

p0→Δtm
p1→Δty
p2→Δty
p3→Δtc
p4→Δtc
p5→Δtc
p6→Δtc

Figure 11:
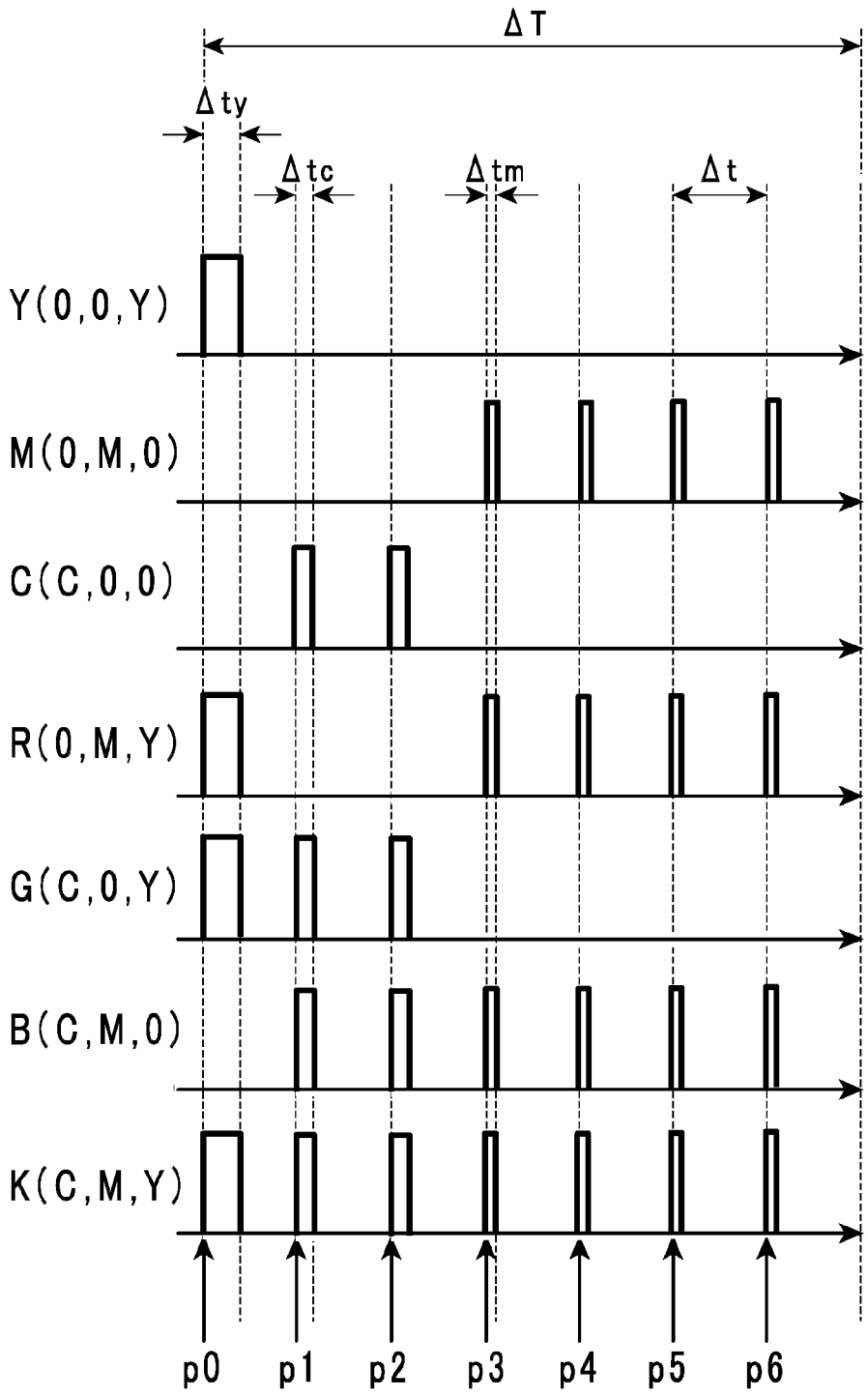
FIG. 11 is a diagram illustrating an example of drive pulses for the second print medium.
Figure 14:
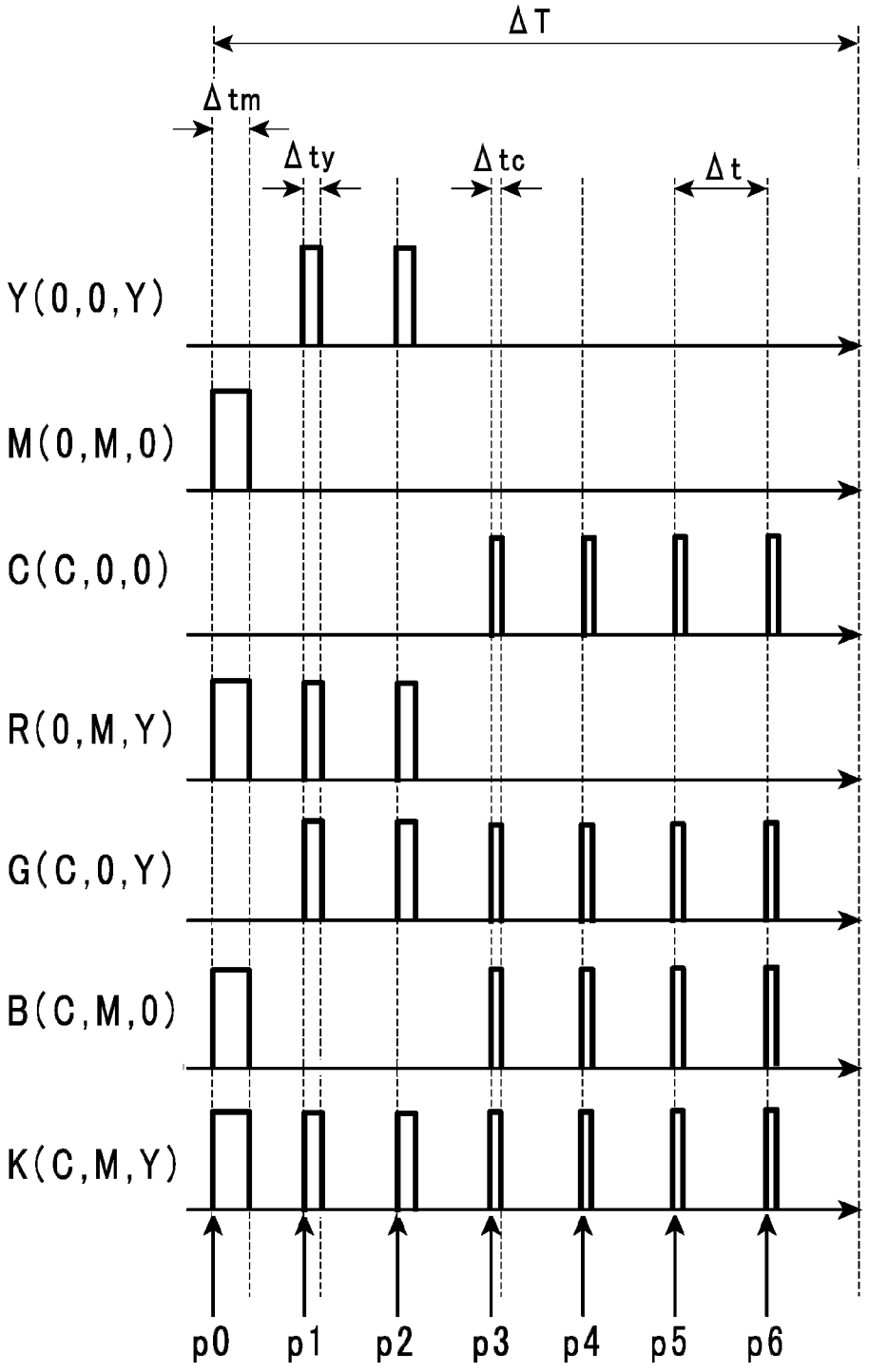
FIG. 14 is a diagram illustrating an example of drive pulses for the third print medium.

FIG. 11 is a diagram illustrating an example of the drive pulses determined in the drive pulse determination process in S709 in the case of using the second print medium. Also, FIG. 14 is a diagram illustrating an example of the drive pulses determined in the drive pulse determination process in S709 in the case of using the third print medium. By comparing FIG. 11 with FIG. 8, with which the case of using the first print medium has been described, it can be seen that the signals for developing cyan and the signals for developing magenta are switched. Also, by comparing FIG. 14 with FIG. 8, with which the case of using the first print medium has been described, it can be seen that the signals for developing magenta and the signals for developing yellow are switched.

Figure 12A:
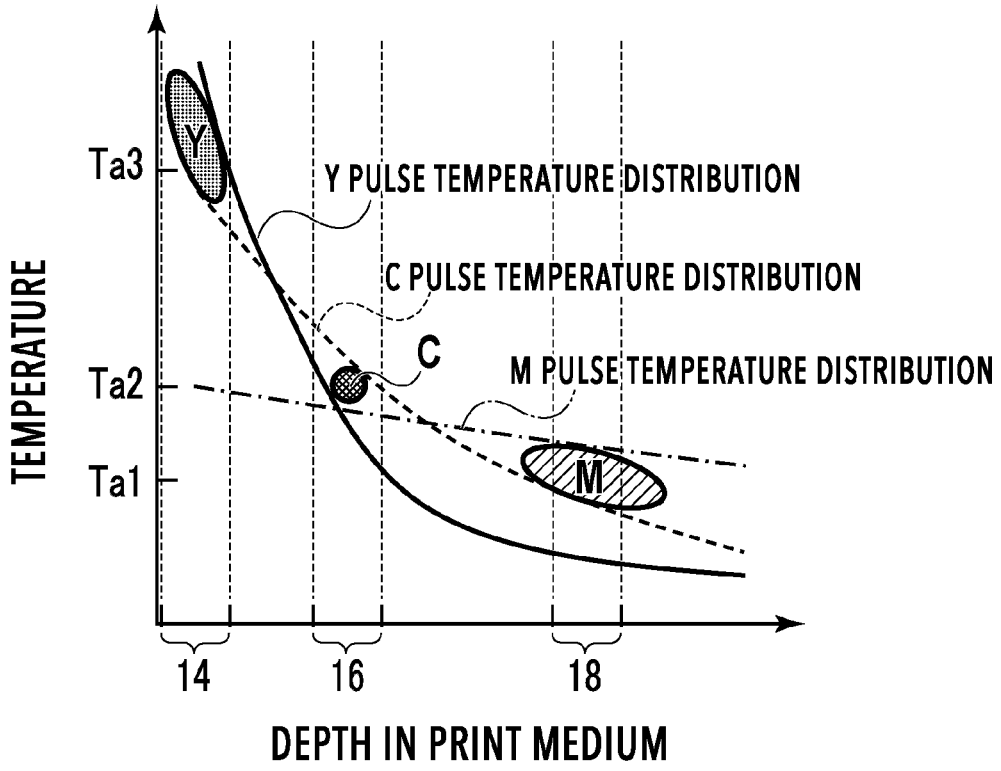
FIGS. 12A and 12B are diagrams illustrating print characteristics of the second print medium.
Figure 12B:
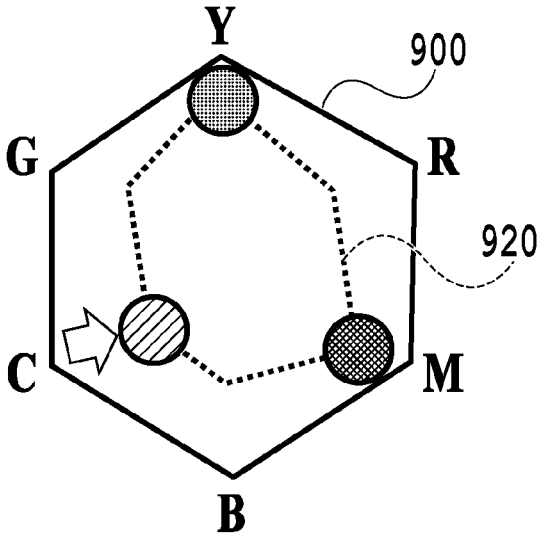

FIGS. 12A and 12B are diagrams like FIGS. 9A and 9B in the case of using the second print medium, illustrating the correlation between the position in the print medium in the depth direction and its temperature and the color reproduction range. As compared to the case with the first print medium illustrated in FIG. 9A, the relation between the M pulse temperature distribution and the C pulse temperature distribution is reversed. For this reason, in the second print medium, the range (C) for the second image forming layer 16, which can be activated with the C pulses, is smaller than the ranges for the other colors. As a result, as illustrated in FIG. 12B, the color reproduction range of hues using cyan is smaller than the other ranges.

Figure 15A:
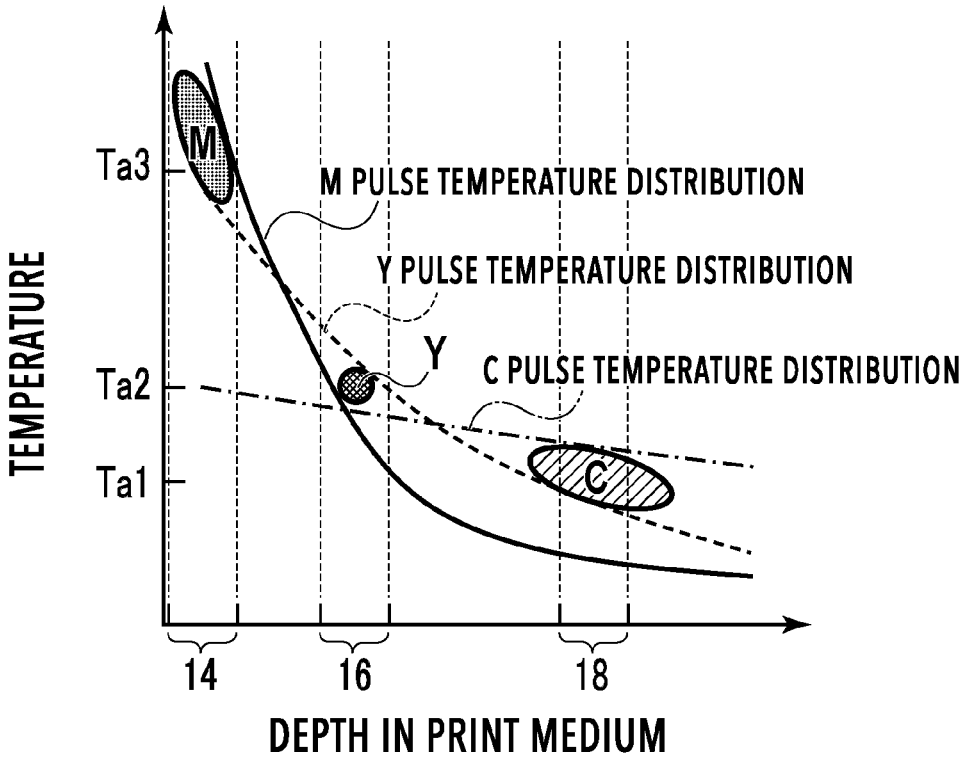
FIGS. 15A and 15B are diagrams illustrating print characteristics of the third print medium.
Figure 15B:
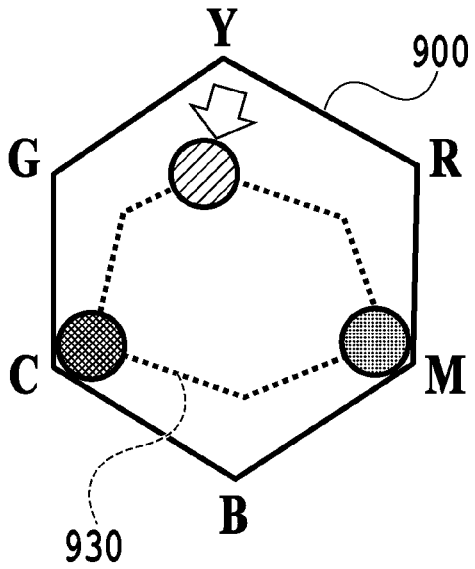

FIGS. 15A and 15B are diagrams like FIGS. 9A and 9B in the case of using the third print medium, illustrating the correlation between the position in the print medium in the depth direction and its temperature and the color reproduction range. As compared to the case with the first print medium illustrated in FIG. 9A, the relation between the M pulse temperature distribution and the Y pulse temperature distribution is reversed. For this reason, in the third print medium, the range (Y) for the second image forming layer 16, which can be activated with the Y pulses, is smaller than the ranges for the other colors. As a result, as illustrated in FIG. 15B, the color reproduction range of hues using yellow is smaller than the other ranges.

By comparing the color reproduction ranges illustrated in FIGS. 9B, 12B, and 15B, it can be seen that the ranges have different local variations. In other words, the first to third print media differ have different color ranges in which good colors can be developed. The most suitable print medium for printing among these first to third print media varies depending on the image data.

Thus, the printing apparatus in the present embodiment employs a heat sensing method and is also capable of printing a plurality of print medium types differing from each other in order of lamination of a plurality of image forming layers. Moreover, for printing, the printing apparatus in the present embodiment uses a different method for each print medium type to generate print data for driving the individual heat development elements. In this way, the user can obtain an image with good colors by using a print medium suitable for the color gamut in the image data to be printed.

In the above description, all of the color correction table, the color conversion table, the pulse width table, and the drive timing table are individually set according to the type of the print medium. Note, however, that not all of these tables need to be changed according to the type of the print medium. In order that the image forming layers of the respective colors in the first to third print media are independently and accurately controlled to be activated or not to be activated, it suffices that at least the pulse width and the frequency of application of a drive pulse for each color are controlled appropriately for each print medium. In short, in the present embodiment, it suffices that at least a pulse width table and a drive timing table are prepared for each print medium.

Meanwhile, in the configuration in the above description, the medium sensor 46 disposed in the printing apparatus 40 determines the type of the conveyed print medium in S702 in FIG. 7. However, the present embodiment is not limited to this configuration. For example, the user may enter the type of the print medium through the keyboard-mouse I/F 505 in the host apparatus or the like.

Also, even with the configuration in which the medium sensor 46 detects the type of the print medium, information on the type of the print medium does not necessarily have to be provided on the print medium. For example, in a package containing print media, a separate sheet may be placed which has the same size as the print media and on which information on the type of the print media, variation, and so on is provided in the form of a one-dimensional barcode or a two-dimensional barcode. Then, before the start of an actual printing operation, this sheet may be conveyed and scanned to determine the type of the print medium to be subsequently conveyed.

Second Embodiment

A printing apparatus 160 in the present embodiment analyzes inputted image data and selects the print medium that can develop the best colors, and performs image processing and a print head drive operation suitable for the print medium.

Figure 16:
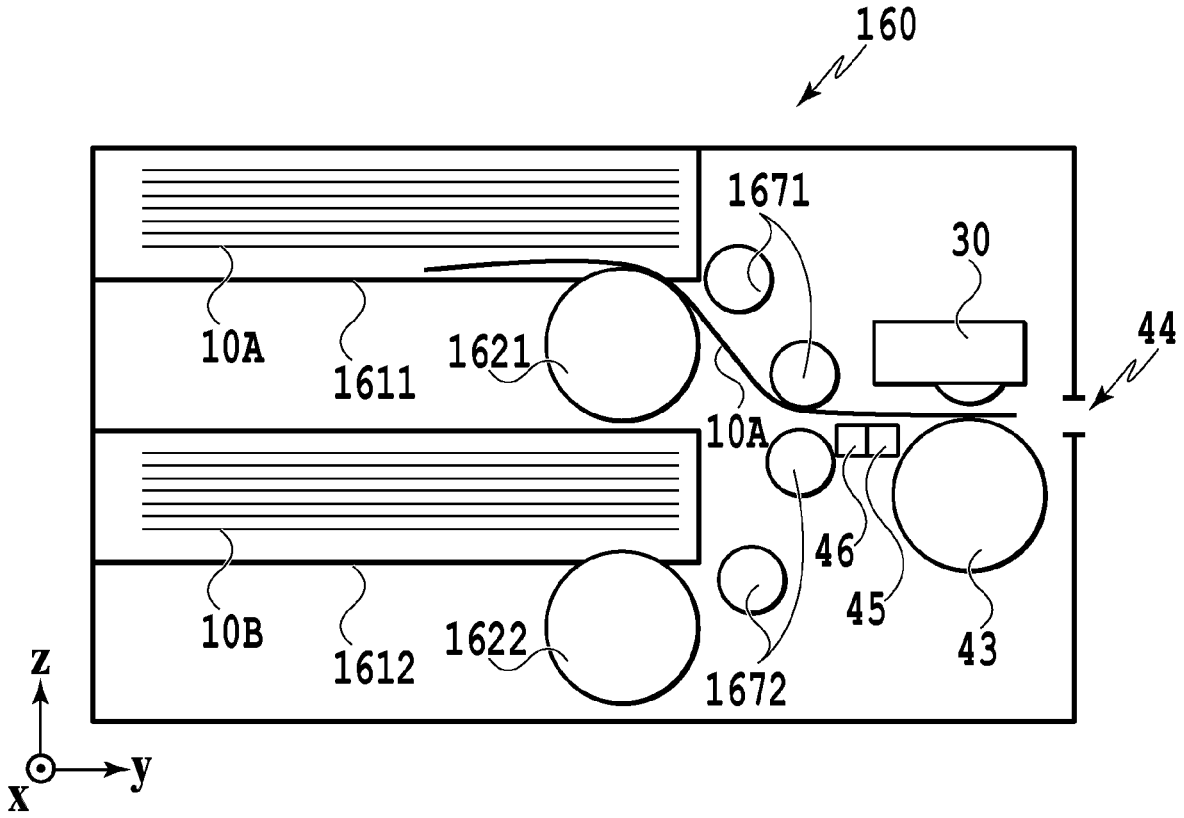
FIG. 16 is an internal configuration diagram of a printing apparatus used in a second embodiment.

FIG. 16 is an internal configuration diagram of the printing apparatus 160, used in the present embodiment. The printing apparatus 160 in the present embodiment includes a first tray 1611 and a second tray 1612 for housing different types of print media.

A bottom print medium 10A housed in the first tray is fed by a first feed roller 1621 and conveyed by first conveyance rollers 1671 to a printing zone at which a print head 30 and a platen 43 are disposed. On the other hand, a bottom print medium 10B housed in the second tray is fed by a second feed roller 1622 and conveyed by second conveyance rollers 1672 to the printing zone at which the print head 30 and the platen 43 are disposed. Besides the above, the print head 30, the platen 43, a medium sensor 46, a temperature sensor 45, and a discharge port 44 are similar to those in the first embodiment described by using FIG. 4.

The print media 10A housed in the first tray 1611 and the print media 10B housed in the second tray 1612 are any of the first to third print media described in the first embodiment and are mutually different types.

In the present embodiment too, the printing system illustrated in FIG. 5 is used, and a print service providing process is executed by following the flowchart illustrated in FIG. 6. In addition, the printer CPU 401 in the present embodiment has already obtained the types of the print media housed in the first tray 1611 and the second tray 1612. In the following example, the first and second print media are housed in the first and second trays 1611 and 1612, respectively.

Figure 17:
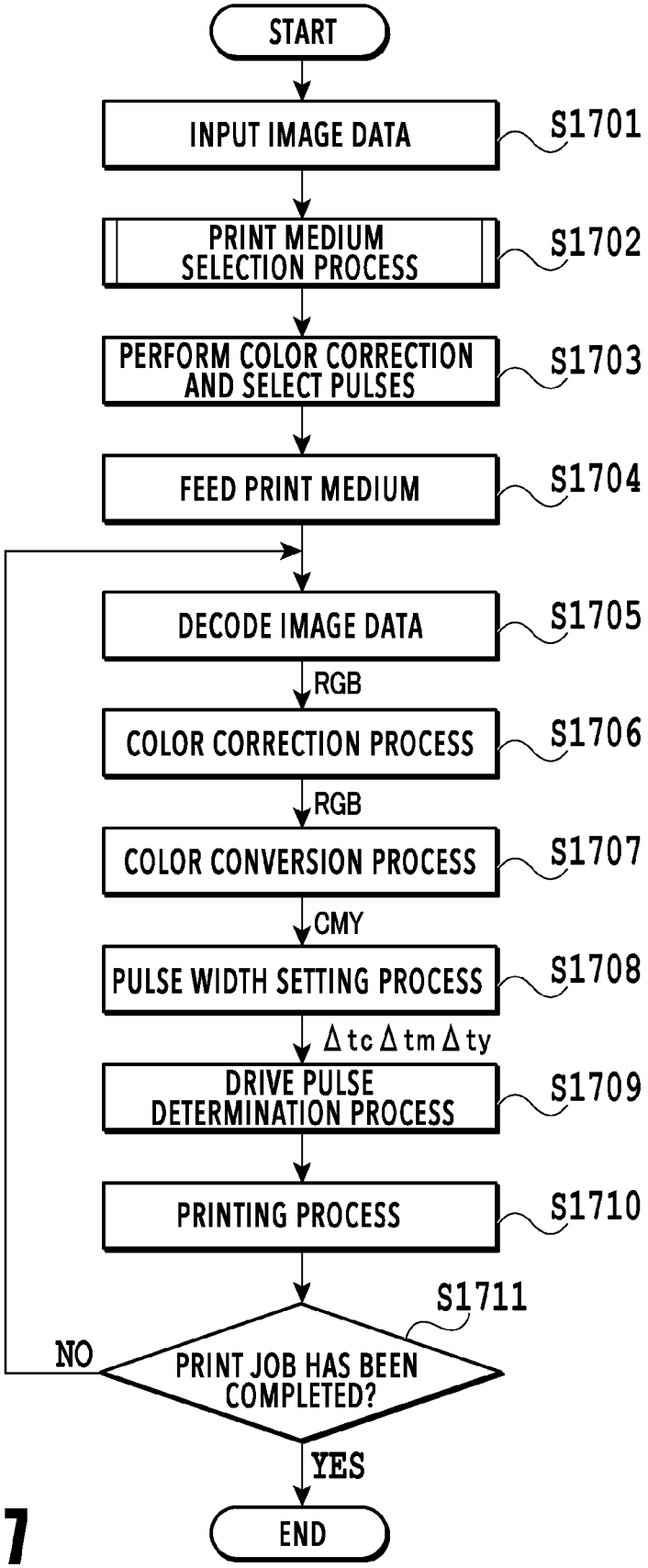
FIG. 17 is a flowchart for explaining a print job execution sequence.

FIG. 17 is a flowchart for explaining a print job execution sequence executed by the printer CPU 401 in the present embodiment in S615 in FIG. 6. The flowchart in FIG. 17 differs from the flowchart in FIG. 7, described in the first embodiment, in that the image data is obtained and analyzed to select a suitable print medium type prior to performing a print medium feed process (S1704).

Upon start of this processing, firstly in S1701, the printer CPU 401 deploys the image data received in S614 to the RAM 402. Then in S1702, the printer CPU 401 executes a print medium selection process.

Figure 18:
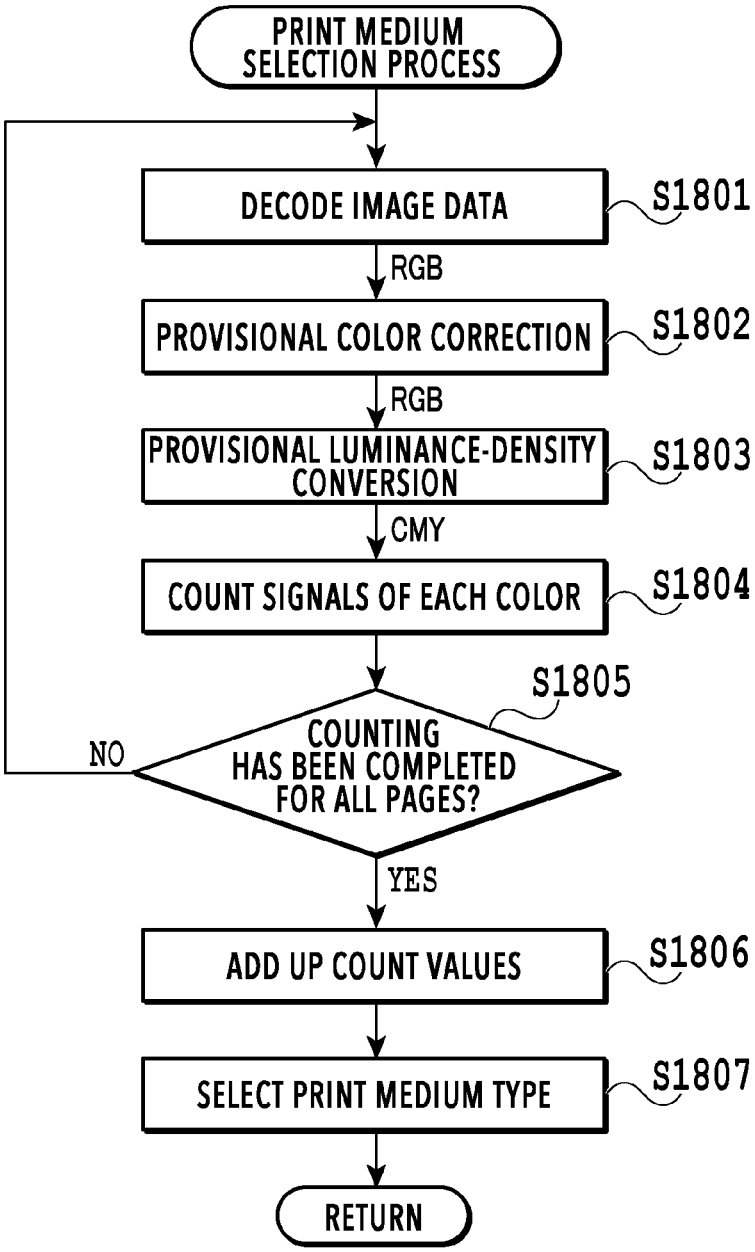
FIG. 18 is a flowchart for explaining steps on a print medium selection process.

FIG. 18 is a flowchart for explaining steps in the print medium selection process. Upon start of this process, firstly in S1801, the printer CPU 401 decodes the data of a single page in the compressed deployed to the RAM 402.

Then in S1802 and S1803, the printer CPU 401 performs a provisional color correction process and a provisional color conversion process, respectively. The processes are "provisional" because suitable tables cannot be selected at the current stage, at which the print medium type has not been selected. At this point, the printer CPU 401 performs a conversion process using a color correction table and a color conversion table prepared for a standard print medium. Such tables may be obtained, for example, by averaging a plurality of tables prepared for different types of print media or by performing mapping on a color gamut obtained by logical disjunction of a plurality of print media's color reproduction ranges. In any case, the input luminance signals (R, G, B) are converted into density signals (C, M, Y) by S1802 and S1803.

In S1804, the printer CPU 401 calculates the sums of the density signals (C, M, Y) in the entire image obtained in S1803. Specifically, the printer CPU 401 adds up the cyan signal values C, the magenta signal values M, and the yellow signal values Y of all pixels in the image to obtain a count value Cc, a count value Cm, and a count value Cy, respectively.

After finishing the counting for the single page, the printer CPU 401 proceeds to S1805 to determine whether the counting has been completed for all pages in the received image data. If determining that there is a page(s) remaining to be counted, the printer CPU 401 returns to S1801 for the counting process for the next page. On the other hand, if determining in S1805 that the counting has been completed for all pages, the printer CPU 401 proceeds to S1806.

In S1806, the printer CPU 401 individually calculates the sums of the count values Cc, the count values Cm, and the count values Cy of all pages. Then, the printer CPU 401 proceeds to S1807, in which it selects the suitable print medium between the first print medium 10A, housed in the first tray 1611, and the second print medium 10B, housed in the second tray 1612, on the basis of the magnitude relation between the sums.

For example, in a case where the set of cyan count values Cc is the largest among the three sets of count values, the printer CPU 401 selects the print medium not containing a cyan color material in the second image forming layer, i.e., the first print medium. In a case where the set of magenta count values Cm is the largest, the printer CPU 401 selects the print medium not containing a magenta color material in the second image forming layer, i.e., the second print medium.

In a case where the set of yellow count values Cy is the largest, the printer CPU 401 selects a print medium not containing a yellow color material in the second image forming layer. In the present example, both the first print medium and the second print medium meet this definition. In such a case, the printer CPU 401 may select the print medium on the basis of the second largest set of count values among the three sets of count values. Specifically, the printer CPU 401 may select the first print medium in a case where the second largest set of count values is Cc whereas the printer CPU 401 may select the second print medium in a case where the second largest set of count values is Cm. In any case, between the first print medium and the second print medium, the more preferable print medium for the input image data is selected in S1807.

Referring back to the flowchart in FIG. 17, after selecting the suitable print medium in S1702, then in S1703, the printer CPU 401 reads out the color correction table, the color conversion table, the maximum pulse width for each color, and the drive timing table for the selected print medium type and deploys them to the RAM 402.

After the various tables and parameters for the print medium suitable for the image data are thus deployed, the printer CPU 401 feeds the selected print medium to the printing zone in S1704. For example, in the case where the first print medium has been selected, the printer CPU 401 rotates the feed roller 1621 and the conveyance rollers 1671 with the conveyance motor driver 407 to feed the first print medium 10A at the bottom in the first tray 1611 to the printing zone. Also, in the case where the second print medium has been selected, the printer CPU 401 rotates the feed roller 1622 and the conveyance rollers 1672 with the conveyance motor driver 407 to feed the second print medium 10B at the bottom in the second tray 1612 to the printing zone.

The subsequent processes in S1705 to S1711 are similar to S705 to S711, described in FIG. 7. Specifically, the printer CPU 401 performs a color correction process, a color conversion process, a pulse width setting process, and a drive pulse determination process by using the tables and parameters for the type of the fed print medium, and executes a printing process with the drive pulses (print data) thus determined.

In the above, in the print medium selection process in S1702, the signal values C, M, and Y of all pixels in the image after the color conversion are added up to obtain the count values Cc, Cm, and Cy, respectively. Note however that the method of obtaining the count values Cc, Cm, and Cy is not limited to this method. For example, the number of pixels whose cyan signal value C is not 0, the number of pixels whose magenta signal value M is not 0, and the number of pixels whose yellow signal value Y is not 0 may be obtained as the count values Cc, Cm, and Cy, respectively. Still alternatively, numbers Cr, Cg, and Cb of pixels whose respective signal values R, G, and B after the decoding in S1801 are not 0 may be counted, and the sum of Cr and Cg, the sum of Cr and Cb, and the sum of Cg and Cb may be obtained as Cy, Cm, and Cc, respectively. In this case, the provisional color correction process in S1802 and the provisional color conversion process in S1803 are omitted, thereby allowing faster processing.

Also, the print medium can be selected on the basis of the distribution of the RGB data after the color correction process.

Figure 19:
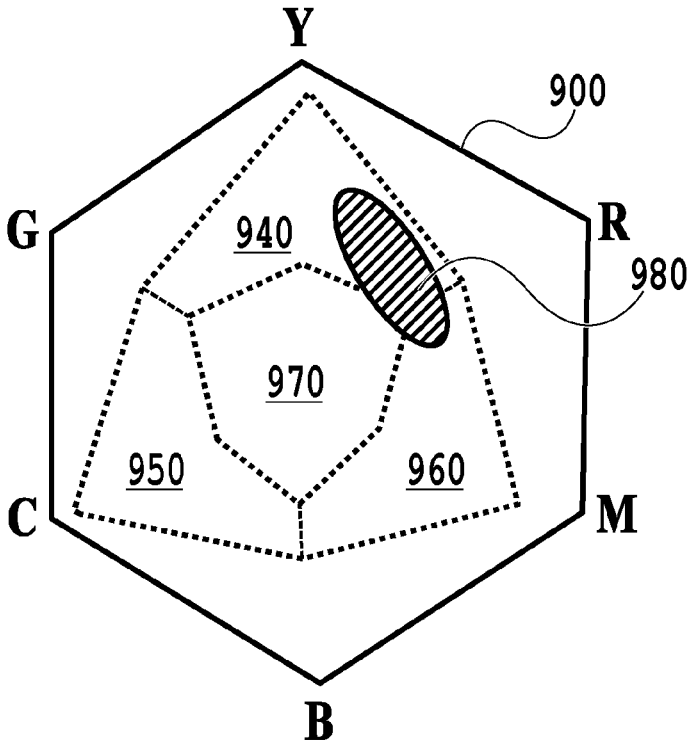
FIG. 19 is a diagram for comparing a color reproduction range in a standard format and the color reproduction range of the printing apparatus.

FIG. 19 is a diagram for comparing the color reproduction range 900 in the standard format and a color reproduction range expressible by the printing apparatus 160 in the present embodiment. In this diagram, the dotted lines represent the sum of the color reproduction ranges for the printing of the first print medium, the second print medium, and the third print medium. In the diagram, a range 960 represents the range of colors that cannot be reproduced with the first print medium. A range 950 represents the range of colors that cannot be reproduced with the second print medium. A range 940 represents the range of colors that cannot be reproduced with the third print medium. Also, a range 970 represents the range of colors that can be reproduced with any of the first to third print media.

For example, in a case where the distribution of the input image data (R, G, B) is a range 980 in the diagram, the ranges 940, 960, and 970 overlaps the range 980. Thus, in this case, the print medium that is neither the third print medium, which cannot reproduce the colors in the range 940, nor the first print medium, which cannot reproduce the colors in the range 960, i.e., the second print medium, can be determined as the suitable print medium.

In the contents of the above description, the print medium selection process illustrated in FIG. 18 is executed by the printer CPU 401 of the printing apparatus 160. Note however that the print medium selection process may be performed by the host CPU 501 of the host apparatus 50. In this case, the host apparatus may provide the printing apparatus 160 with information on the selected print medium type along with the image data, and the printing apparatus 160 may perform the processes at and after S1703 in accordance with the received information.

According to the above-described embodiment, a print medium suitable for an image to be printed is automatically selected without the help of the user, and image processing and a printing process suitable for the selected print medium are performed. The user can therefore stably obtain an image with good colors from a printing apparatus that prints color images by using a heat sensing method.

Third Embodiment

In the second embodiment, a description has been given of a configuration in which a suitable print medium is automatically conveyed on the basis of the result of an analysis on the image to be printed. Unlike this, in the configuration in the present embodiment, the user is notified of a suitable print medium type on the basis of the result of an analysis on the image to be printed.

In the present embodiment, the same printing apparatus as that in the first embodiment, illustrated in FIG. 4, is used. Also, the printing system illustrated in FIG. 5 is used, and a print service providing process is executed by following the flowchart illustrated in FIG. 6.

Figure 20:
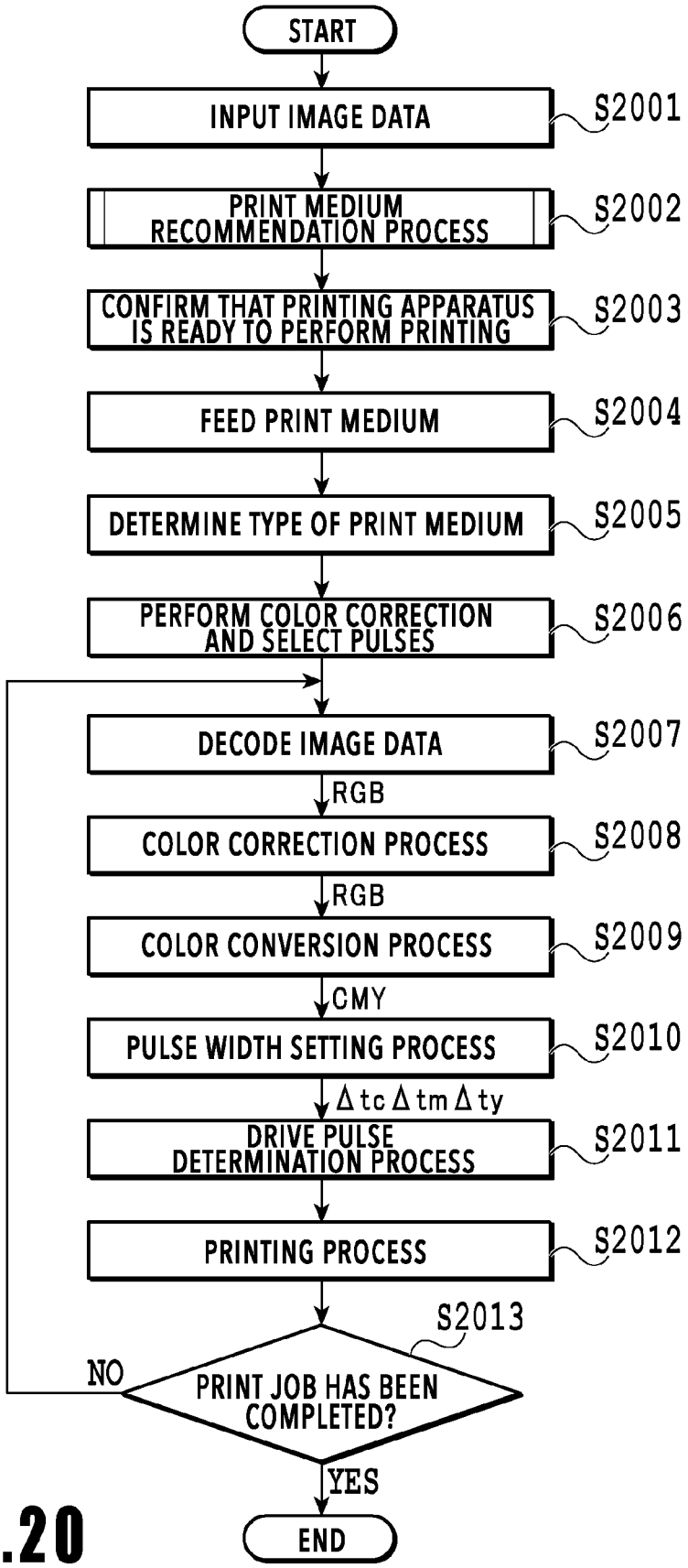
FIG. 20 is a flowchart for explaining a print job execution sequence.

FIG. 20 is a flowchart for explaining a print job execution sequence executed by the printer CPU 401 in the present embodiment in S615. Upon start of this processing, firstly in S2001, the printer CPU 401 deploys the image data received in S614 in FIG. 6 to the RAM 402. Then in S2002, the printer CPU 401 executes a print medium type recommendation process.

In the present embodiment, the print medium type recommendation process is a process for selecting a recommended print medium type and notifying the user of it. Basically, the method of selecting a recommended medium involves substantially the same process as the print medium selection process in S1702, described in the second embodiment, and description thereof is therefore omitted here. Note that while in the second embodiment a suitable print medium type is selected from among the types of the print media housed in the trays inside the apparatus, in the present embodiment the most suitable print medium type is selected from among a larger number of types including print media that are not housed in the apparatus. Then, the print medium type suitable for the analyzed image data is presented to the user by some means.

For example, a red LED light and a blue LED light may be installed on the body of the printing apparatus, and the blue LED light may be turned on in a case of recommending the first print medium, the red LED light may be turned on in a case of recommending the second print medium, and both the red and blue LED lights may be turned on in a case of recommending the third print medium. Alternatively, information on the recommended print medium may be displayed on the display of the printing apparatus 40 or the host apparatus 50. In this case, the tray in which to insert the recommended print medium can be displayed on the display as well. After checking such information, the user only needs to select the recommended print medium from among the print media the user currently has, and insert it into the tray in the apparatus.

The printer CPU 401 confirms in S2003 that the printing apparatus is ready to perform printing in a case where the user houses the selected print medium into the tray 41 in the printing apparatus 40 and presses a start button installed on the printing apparatus 40. Note that such confirmation may be done by having the user enter information indicating that the insertion of the print medium has been completed to the host apparatus 50, or be replaced with the closing of the lid of the tray 41 by the user.

After the confirmation in S2003 is completed, the printer CPU 401 feeds a print medium in S2004 and determines the type of the fed print medium in S2005. Then, the printer CPU 401 reads out the various tables and parameters for the print medium type determined in S2005 from the ROM 403 and deploys them to the RAM 402. The subsequent processes in S2007 to S2013 are similar to S705 to S711, described in FIG. 7. Specifically, the printer CPU 401 performs a color correction process, a color conversion process, and a drive pulse determination process for the type of the fed print medium, and executes a printing process with the drive pulses thus determined.

Note that the type of the print medium determined in S2005 is not always the same as the print medium type recommended in S2002 because there may possibly be a case where the recommended print medium is not included in the print media the user currently has or a case where the user purposely uses a particular print medium. Even in such cases, in S2006, the printer CPU 401 deploys the various tables and parameters for the type of the print medium determined in S2005 and executes image processing in accordance with the tables and parameters, which are suitable for the print medium to be used. Here, in the case where the type of the print medium determined in S2005 is different from the print medium type recommended in S2002, the printer CPU 401 may notify the user that the most suitable color reproduction will not be performed. In this way, it is possible to prompt the user to prepare the preferable print medium for the next printing.

Also, the print medium type recommendation process in S2002 does not need to be performed for all pieces of image data contained in the print job. Assume for example that a print job has been generated for images captured at the same time and date in the same scene, such as pictures of a party. In this case, these images have similar hues, so that the same print medium type is likely to be recommended. Thus, in cases as above, the most suitable print medium type may be set on the basis of the analysis on some of the plurality of pieces of image data.

Also, an image data analysis and a suitable print medium notification as described above may also be made for image data other than image data for which a print command is received. For example, photographic images stored in a folder in the host apparatus may be analyzed as appropriate regardless of whether a print job has been issued or not, and the user may be notified of a print medium type suitable for the stored images. In this case, the user may be notified of information on a recommended print medium type for each individual image management folder or each image capture date and time, or the user may be notified selectively of a folder designated by the user. Also, the user may be notified of one or more suitable print medium types on the basis of the average hues or trend of images contained in a plurality of folders. In this way, the user can prepare the most suitable print medium in advance before a print job is issued.

While the timing for recommending a print medium type is not particularly limited, the timing may be, for example, when the tray runs out of print media, when the recommended sheet type is changed from a usual one, or the like.

OTHER EMBODIMENTS

In the configurations in the description of the above embodiments, a suitable print medium is selected from among the first to third print media, but a larger number of print medium types may be prepared. With a configuration in which the first to third image forming layers are associated with cyan, magenta, and yellow in a one-to-one correspondence, as in the above embodiments, it is possible to prepare up to six print medium types differing from each other in order of lamination. Moreover, besides cyan, magenta, and yellow layers, individual layers of colors such as black, red, green, and blue may be prepared as color elements. Furthermore, each print medium may be a print medium with at least one image forming layer disposed on both front and back surfaces of a transparent base material. In this case, the base material itself also serves as a spacer layer.

In the configurations in the description of the above embodiments, each individual pixel covers a region measuring approximately 40 μm in both the x direction and the y direction, that is, the individual pixels are arrayed at a density of approximately 600 dpi (dots/inch). However, the present invention is not of course limited to such a resolution. It suffices that the image resolution is within the range of 100 to 600 dpi, and the image resolution may be different in the x direction and the y direction.

In the configurations in the description of the above embodiments, the characteristic series of image processing operations of the present invention is executed by the CPU 401 of the printing apparatus 40 or 160, but the present invention is not limited to such configurations. Part or entirety of the flowcharts described in FIGS. 7, 17, 18, and 20 may be performed by the CPU 501 of the host apparatus.

Also, in the above embodiments, a print head with a plurality of heat generation elements arrayed in the width direction of the print medium (x direction) is fixed inside the apparatus, and an image is printed by conveying the print medium in the y direction, which crosses the width direction (x direction). However, the present invention is not limited to such a configuration. The configuration may be such that an image is printed by alternately repeating a print scanning which applies voltage pulses at individual pixel positions while moving the print head at a predetermined speed in the x direction and a conveyance operation which conveys the print medium in the y direction.

Also, in the above embodiments, heat generation elements (heaters) having a width equivalent to the width of a pixel are used, and the tone of each individual pixel region is expressed by modulating the width of the pulse(s) to be applied to the corresponding heat generation element. However, the present invention is not limited to such a configuration. For example, it is possible to modulate the voltage value of the voltage pulse(s) to be applied to the heat generation element. Also, the configuration may be such that each individual pixel region is irradiated with an intensity-modulatable laser ray to activate the corresponding image forming layer(s), for example.

In any case, the advantageous effect of the present invention can be achieved as long as it is possible to print images in a plurality of print media having different types and numbers of layers, different layer thicknesses, or different orders of lamination by performing suitable drive control for each print medium.

The present invention can be implemented with a process involving: supplying a program that implements one or more of the functions in the above embodiments to a system or an apparatus through a network or a storage medium; and causing one or more processors in a computer in the system or the apparatus to read out and execute the program. Also, the present invention can be implemented with a circuit that implements one or more of the functions (e.g., ASIC).

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-133535 filed Jul. 13, 2018, which is hereby incorporated by reference wherein in its entirety.

What is claimed is:

1. A printing apparatus comprising:

a print head having a heat generation element;

a generation unit configured to generate print data on a basis of image data, the print data being for driving the heat generation element to form an image on a print medium including a laminate of a plurality of image forming layers that develop mutually different colors by receiving heat; and a drive unit configured to drive the heat generation element of the print head on a basis of the print data generated by the generation unit, wherein the generation unit generates the print data depending on a type of the print medium such that an operation of the heat generation element driven according to print data generated based on image data for printing a first print medium, and an operation of the heat generation element driven according to print data generated based on image data for printing a second print medium of which order of lamination of the plurality of the image forming layers is different from order of lamination of the plurality of image forming layers of the first print medium, are different.

2. The printing apparatus according to claim 1, wherein the print data is a voltage pulse to be applied to the heat generation element for a pixel region, and the generation unit generates the print data such that control of the voltage pulse for the pixel region varies depending on the type of the print medium.

3. The printing apparatus according to claim 2, wherein the print data is generated by performing the control of the voltage pulse such that the voltage pulse varies in pulse width and frequency of application.

4. The printing apparatus according to claim 3, further comprising:

a storage unit configured to store pulse width tables for setting the pulse width of the voltage pulse and drive timing tables for setting a drive timing of the voltage pulse in association with the plurality of print medium types; and a determination unit configured to determine the type of the print medium, wherein the generation unit reads out the pulse width table and the drive timing table associated with the type of the print medium determined by the determination unit from the storage unit and generates the print data on a basis of the pulse width table and the drive timing table.

5. The printing apparatus according to claim 4, wherein the storage unit stores color correction tables in association with the plurality of print medium types, each of the color correction tables being a table for performing a color correction process such that a color reproduction range of inputted image data corresponds to a color reproduction range expressible by the printing apparatus, and the generation unit reads out the color correction table associated with the type of the print medium determined by the determination unit from the storage unit, and performs the color correction process on a basis of the color correction table.

6. The printing apparatus according to claim 4, wherein the storage unit stores color conversion tables in association with the plurality of print medium types, each of the color conversion tables being a table for performing a color conversion process for converting inputted image data into image data adapted to color materials included in the print medium, and the generation unit reads out the color conversion table associated with the type of the print medium determined by the determination unit from the storage unit, and performs the color conversion process on a basis of the color conversion table.

7. The printing apparatus according to claim 4, wherein the determination unit determines the type of the print medium by reading a symbol provided on a back surface of the print medium.

8. The printing apparatus according to claim 4, wherein the determination unit determines the type of the print medium by reading a symbol provided on a sheet that is not the print medium and is conveyed before the print medium.

9. The printing apparatus according to claim 4, wherein the determination unit determines the type of the print medium on a basis of information on the print medium inputted by a user.

10. The printing apparatus according to claim 1, further comprising a selection unit configured to select a preferable print medium type for printing image data by analyzing the image data.

11. The printing apparatus according to claim 10, wherein the selection unit selects the preferable print medium type on a basis of a distribution of hues in the image data.

12. The printing apparatus according to claim 10, wherein the selection unit selects the preferable print medium type by analyzing a plurality of pieces of image data for which a print job has not yet been generated.

13. The printing apparatus according to claim 10, further comprising a unit configured to selectively feed the print medium of the type selected by the selection unit from one of a plurality of trays housing the print media of different types.

14. The printing apparatus according to claim 10, further comprising a unit configured to notify a user of the print medium type selected by the selection unit.

15. The printing apparatus according to claim 1, wherein the mutually different colors are cyan, magenta, and yellow.

16. The printing apparatus according to claim 1, wherein a plurality of the heat generation elements are arrayed on the print head to extend in a length corresponding to a width of the print medium, and an image is printed in the print medium by conveying the print medium relative to the print head in a direction crossing the arraying direction.

17. The printing apparatus according to claim 1, wherein an image is printed on the print medium by repeating a print scanning in which the print head prints the print medium while moving in a width direction of the print medium and a conveyance operation which conveys the print medium in a direction crossing the direction of the print scanning.

18. An image processing apparatus that performs an image processing for printing an image on a print medium by using a print head having a heat generation element, the print medium including a laminate of a plurality of image forming layers that develop mutually different colors by receiving heat, the image processing apparatus comprising:

one or more memory devices that store a set of instructions; and one or more processors that execute the set of instructions to perform operations including:

generating print data depending on a type of the print medium such that an operation of the heat generation element driven according to print data generated based on image data for printing a first print medium, and an operation of the heat generation element driven according to print data generated based on image data for printing a second print medium of which order of lamination of the plurality of the image forming layers is different from order of lamination of the plurality of image forming layers of the first print medium, are different, wherein the print data is for driving the heat generation element for each of individual pixel regions.

19. An image processing method comprising:

setting a medium selected among a plurality of print medium types that differ from each other in order of lamination of a plurality of image forming layers thereof;

generating print data on a basis of image data, the print data being for forming an image on a print medium including a laminate of a plurality of image forming layers that generate mutually different colors by receiving heat; and driving a heat generation element of a print head on a basis of the print data generated by the generating, wherein the generating includes generating the print data depending on the set type of the print medium.

20. A non-transitory computer readable storage medium storing a program that causes a computer to function as units of a printing apparatus, the printing apparatus comprising:

a generation unit configured to generate print data on a basis of image data, the print data being for forming an image on a print medium including a laminate of a plurality of image forming layers that generate mutually different colors by receiving heat; and a drive unit configured to drive a heat generation element of a print head on a basis of the print data generated by the generation unit, wherein the generation unit generates the print data depending on a type of the print medium such that an operation of the heat generation element driven according to print data generated based on image data for printing a first print medium, and an operation of the heat generation element driven according to print data generated based on image data for printing a second print medium of which order of lamination of the plurality of the image forming layers is different from order of lamination of the plurality of image forming layers of the first print medium, are different.

21. A printing apparatus comprising:

a print head having a heat generation element;

a receiving unit configured to receive an information indicating that the type of a loaded print media in the printing apparatus is a first media and configured to receive an information indicating that the type of a loaded print media in the printing apparatus is a second media, wherein the first media and the second media are different from each other in order of lamination of a plurality of image forming layers that develop mutually different colors by receiving heat;

a generation unit configured to generate print data on a basis of image data, the print data being for driving the heat generation element to form an image on a print medium including a laminate of the plurality of image forming layers; and a drive unit configured to drive the heat generation element of the print head on a basis of the print data generated by the generation unit, wherein the generation unit generates the print data depending on the information received by the receiving unit.

22. A printing method of a printing apparatus that is equipped with a print head having a heat generation element, comprising:

generating print data on a basis of image data, the print data being for driving the heat generation element to form an image on a print medium including a laminate of a plurality of image forming layers that develop mutually different colors by receiving heat; and driving the heat generation element of the print head on a basis of the print data generated by the generation unit, wherein the print data is generated depending on a type of the print medium such that an operation of the heat generation element driven according to a print data generated based on image data for printing a first print medium, and an operation of the heat generation element driven according to print data generated based on image data for printing a second print medium of which order of lamination of the plurality of the image forming layers is different from order of lamination of the plurality of image forming layers of the first print medium, are different.

* * * * *